US009228809B1

(12) United States Patent
Relyea

(10) Patent No.: US 9,228,809 B1
(45) Date of Patent: Jan. 5, 2016

(54) TARGET PRACTICE APPARATUS

(71) Applicant: Carousel Targets, LLC, Clearwater, FL (US)

(72) Inventor: Michael J. Relyea, Zephyrhills, FL (US)

(73) Assignee: Carousel Targets, LLC, Clearwater, FL (US)

( * ) Notice: Subject to any disclaimer, the term of this patent is extended or adjusted under 35 U.S.C. 154(b) by 0 days.

(21) Appl. No.: 14/223,129

(22) Filed: Mar. 24, 2014

(51) Int. Cl.
*F41J 9/02* (2006.01)
*F41J 1/10* (2006.01)

(52) U.S. Cl.
CPC ..... *F41J 9/02* (2013.01)

(58) Field of Classification Search
CPC ..... F41J 9/00; F41J 9/02
USPC ..... 273/359, 366–370, 390–392, 406–408; 40/435; 446/236; 473/427
See application file for complete search history.

(56) References Cited

U.S. PATENT DOCUMENTS 1,488,647 A * 4/1924 Quinn ..... 273/368
1,540,802 A * 6/1925 Ordway ..... 273/368
5,494,278 A * 2/1996 Linden ..... 473/427
5,934,678 A * 8/1999 Theissen et al. ..... 273/386
6,015,262 A * 1/2000 Huang ..... 416/100
6,478,301 B1 * 11/2002 Witmeyer ..... 273/391
7,497,441 B2 * 3/2009 Marshall et al. ..... 273/391
7,950,667 B2 * 5/2011 Shum ..... 273/406
2014/0227940 A1 * 8/2014 Jones ..... 446/236

* cited by examiner

*Primary Examiner* — Melba Bumgarner
*Assistant Examiner* — Laura L Davison
(74) *Attorney, Agent, or Firm* — Inventions International Inc.; Tiffany C. Miller

(57) ABSTRACT

A target practice apparatus adapted to receive projectiles fired at it by a remotely positioned shooter includes a motor having an output shaft, a motor housing, and a post secured to the motor and motor housing. A target disc is secured to the output shaft and rotates with it. A frame supports the motor housing and the target disc. An L-shaped elbow member is attachable to the frame in a plurality of differing configurations. The post is also attachable to the frame in a plurality of differing configurations and is further attachable to the L-shaped elbow member in a plurality of differing configurations. This enables the target disc to be positioned in a vertical plane facing the shooter or on edge to the shooter and a horizontal plane on edge to the shooter. A non-rotating blocker disc having window openings partially obscures the target disc in the shooter-facing configuration.

17 Claims, 22 Drawing Sheets

TARGET PRACTICE APPARATUS

BACKGROUND OF THE INVENTION

1. Field of the Invention

This invention relates, generally, to devices having utility for target practice. More particularly, it relates to a versatile device that has multiple configurations to challenge the shooter.

2. Description of the Prior Art

Stationary targets have utility for target practice but moving targets provide a greater challenge to the shooter.

Targets that rotate in a vertical plane about a horizontal axis are well known. To make such a target more challenging, U.S. Pat. No. 1,488,647 discloses such a target which is masked by a stationary wall having an arcuate window formed therein. The curvature of the window matches the curvature of the rotating target. Accordingly, the target is seen only briefly by the shooter as it passes behind the window.

There are also multiple patents that disclose amusement park devices that present multiple small moving targets to a shooter that fold away from the shooter when struck with a pellet or other low power projectile. Each target returns to its upright position of repose shortly after having been struck by a low power projectile.

A common characteristic of prior art devices in this field is that they have a single configuration, i.e., they present a particular challenge to a shooter and cannot be modified to present a different challenge to the shooter. The shooter thus tires of the device for the same reason that shooters tire of stationary targets.

Another common characteristic of the prior art devices is that they are essentially indestructible because they are made with materials that are substantially impervious to low power projectiles and therefore can be struck with projectiles thousands of times with little or no deterioration.

Professional civilian, law enforcement, military and private indoor and outdoor gun ranges throughout the U.S. include targets and target backgrounds made of corrugated or fluted cardboard, fiberboard, heavy-duty layered stock paper, single and mufti-ply paper and paper decals as a part of standard practice, procedures and safety standards.

There is a need for an apparatus that exhibits a high level of versatility so that it can be configured into multiple configurations, each of which offers a high degree of challenge to a shooter.

There is also a need for a target practice apparatus where low, medium and high-power projectiles may be used and which has targets made of low cost materials which are eventually destroyed by the projectiles after extended use and which are then easily replaced.

However, in view of the art considered as a whole at the time the present invention was made, it was not obvious to those of ordinary skill in the art how the needed target practice apparatus could be provided.

SUMMARY OF THE INVENTION

The long-standing but heretofore unfulfilled need for an improved target practice device is now met by a new, useful, and non-obvious invention.

The novel target practice apparatus is adapted to receive projectiles fired at it by a remotely positioned shooter. It includes at least one motor having an output shaft, a housing for the motor and a motor housing post secured to the motor and the motor housing. A target disc is releasably secured to the output shaft for conjoint rotation therewith.

A base supported by a floor, the ground, or other support structure holds a vertical column of hollow construction. In a first embodiment, the motor housing post is slideably received within the hollow interior of the vertical column in differing orientations so that the output shaft of the motor may be positioned parallel to the path of travel of a projectile fired at a target disc that rotates conjointly with the output shaft of the motor or perpendicular to said path of travel. In the former orientation, the target disc faces the shooter and in the latter orientation, the target disc is positioned on edge relative to the shooter.

A frame supports the motor housing and the target disc. An L-shaped elbow member is releasably attachable to the frame in a plurality of differing configurations. The motor housing post is also releasably attachable to the frame in a plurality of differing configurations. The motor housing post is releasably attachable to the L-shaped elbow member as well in a plurality of differing configurations.

The target disc is disposed in a vertical plane in a first configuration of the apparatus and is rotatable about a horizontal axis of rotation. The horizontal axis of rotation is substantially parallel to a path of travel of a projectile fired by the remote shooter and aimed at the target disc. The target disc is substantially perpendicular to the path of travel.

In a second configuration of the apparatus, the target disc is disposed in a vertical plane and is rotatable about a horizontal axis of rotation. The horizontal axis of rotation is substantially perpendicular to a path of travel of a projectile fired by the remote shooter and aimed at the target disc. The target disc is positioned in a plane that is substantially parallel to the path of travel.

The target disc is disposed in a horizontal plane and is rotatable about a vertical axis of rotation in a third configuration of the apparatus. The vertical axis of rotation is substantially perpendicular to a path of travel of a projectile fired by the remote shooter and aimed at the target disc. The target disc is positioned in a plane that is substantially parallel to the path of travel.

At least one target tab is connected to the target disc and is foldable so that it extends therefrom at about a ninety degree angle thereto when the target disc is in the second or third configuration where the target disc is seen on edge.

A non-rotating blocker disc is disposed in closely spaced, parallel relation to the target disc when the target disc is in its first configuration. The non-rotating blocker disc has a size and shape substantially similar to a size and shape of the target disc. At least one window is formed in the non-rotating blocker disc so that the target disc is visible to the shooter through the at least one window. At least one target decal is applied to the target disc so that the target decal is visible to the shooter through the window for each revolution of the target disc about its axis of rotation.

The frame includes an upstanding hollow tube or vertical column of telescopic construction so that its height may be varied. An L-shaped elbow member has a first leg slideably connected to the vertical column in axial alignment with the vertical axis of symmetry of the upstanding tube. A second leg of the L-shaped elbow member is disposed at a ninety degree angle relative to the first leg and at a ninety degree angle to the vertical axis of symmetry of the vertical column.

The motor housing post may be connected to the second leg to position the target disc in a plane perpendicular to a path of travel of a projectile fired at the target disc or it may be connected to the second leg to position the target disc in a plane parallel to a path of travel of a projectile fired at the target disc, said parallel plane causing said target disc to be seen on edge by a shooter and requiring bending of at least one of said target tabs relative to the plane of the target disc.

Still further embodiments include a horizontally-extending platform arm connected to the vertical column. Rotating target discs may be mounted to either or both ends of the platform arm in perpendicular or parallel relation to the shooter to increase the number and complexity of the targets available to the shooter.

The target discs as well as the blocker discs and blocker boards are made of various types of paper or other suitable material so that projectiles pierce through them and do not ricochet therefrom and so that they are gradually destroyed by repeated hits by such projectiles. Each target or blocker disc is therefore formed of inexpensive and readily available paper. Removal of destroyed target and blocker discs and their replacement with new discs requires very little time. Each disc is centrally apertured and is easily slipped onto an output shaft of a motor.

These and other important objects, advantages, and features of the invention will become clear as this disclosure proceeds.

The invention accordingly comprises the features of construction, combination of elements and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Novel system 10 is a modular, expandable shooting target arcade system that can be configured into a large plurality of configurations to offer a large number of shooting challenges. System 10 is compact and portable and can be used indoors and outdoors. Its targets are expendable because they are destroyed after repeated usage.

Novel system 10 improves basic firearm shooting skills for shooters of primer cartridges, rim fire cartridges, black powder, metal pellets, plastic pellets for AIRSOFT® shooting-related sports, BB and all other types and brands of ammunition for hand guns and rifles, projectiles launched from slingshots as well as arrows used by bows and crossbows in archery sports.

Primary components of the rotating target system are formed from plastic tubing, corrugated cardboard, corrugated or dense flat paper board, heavy-duty layered stock paper and single or multi-ply paper. These paper materials provide an intrinsic safety feature because they are ricochet-resistant. The paper also allows high velocity bullets, pellets or BBs that miss the paper target and strike the blocker disc, rotating target disk or the body of the target system to pass through the paper. All projectiles pass cleanly through the paper target material.

The use of these materials provides easy, rapid and inexpensive replacement of parts by the on-scene user without need for special tools or extensive training and helps mitigate "down-time" thus providing more time to actively shoot.

The various parts of the novel system that may be subject to damage if struck by higher velocity projectiles include small electric motors, portable batteries, battery housings, electrical conductors, screws, nuts and a plastic or cardboard handle. These items are preferably positioned at respective maximum distances from the targets.

Figure 1A:
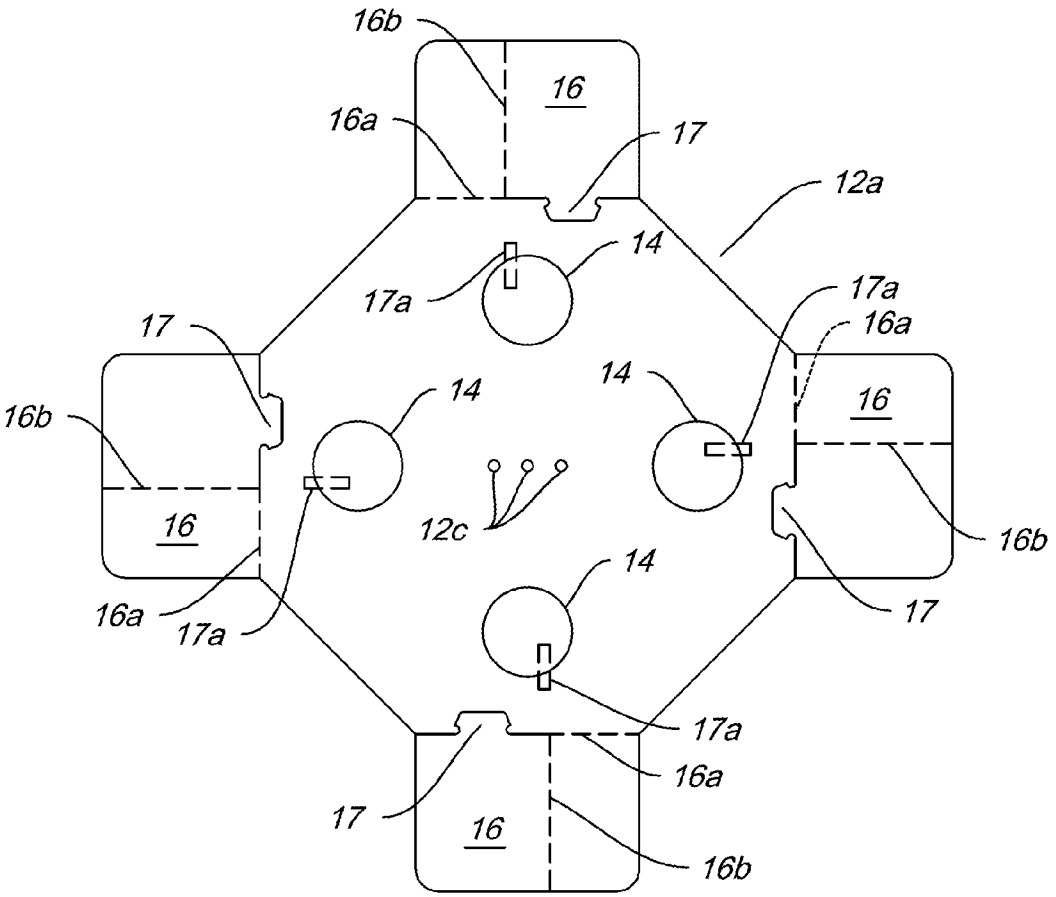
FIG. 1A is a front elevation view of a target disc having unfolded target tabs secured thereto about its periphery.

FIG. 1A depicts an illustrative embodiment of rotating target disc 12*a*. In this particular example, disc 12*a* is flat and has an octagonal shape although such shape could be circular as its name implies, i.e., disc 12*a* may be provided in any predetermined geometrical configuration.

In this example, four (4) paper target decals, collectively denoted 14, are secured to disc 12*a* in circumferentially and equidistantly spaced apart relation to one another. Target decals 14 may be provided in any shape or size and in any random orientation, not just the orderly orientation depicted.

Target tabs 16 are depicted in FIG. 1A as being coplanar with disc 12*a* but said target tabs are not used in that configuration. They are first releasably attached to disc 12*a* by inserting tabs 17 into tab-receiving cut-outs formed in disc 12*a* as depicted in said FIG. 1A, said cut-outs being clearly depicted and not numbered to avoid clutter.

Figure 1B:
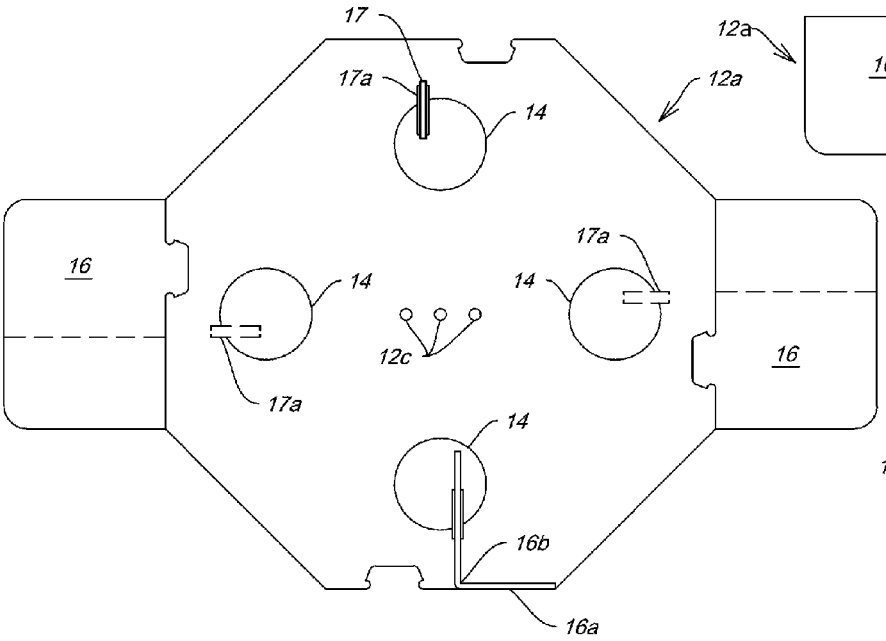
FIG. 1B is a front elevation view of the structure depicted in FIG. 1A but with the target tabs folded.
Figure 1C:
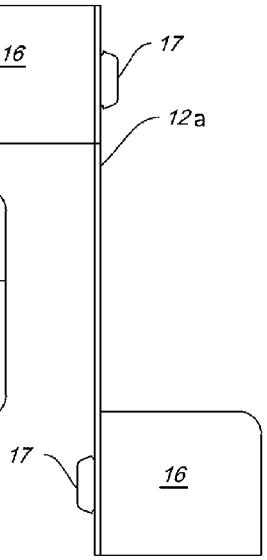
FIG. 1C is an end elevation view of the structure depicted in FIG. 1B.

At least one target tab is then folded along folding line 16*a* so that it is perpendicular to the plane of disc 12*a* as indicated in FIGS. 1B and 1C. A second fold is then made along folding line 16*b*. Tab 17 is removed from its cut-out and fit into slot 17*a* formed in said disc 12*a*. As best understood by comparing FIG. 1B with FIG. 1C, two (2) tabs are mounted so that a first tab extends perpendicularly in a first direction relative to the plane of target disc 12*a*, and a second tab extends perpendicularly in a second, opposite direction. Target tabs 16 remain flat when disc 12*a* is in its FIG. 1A or 1B position, i.e., when disc 12*a* lies in a plane substantially perpendicular to the shooter's line of sight, i.e., substantially perpendicular to the path of travel of each projectile fired by the shooter.

As depicted in FIG. 1C, target tabs 16 are needed when disc 12*a* is parallel to the shooter's line of sight so that only the edge of disc 12*a* can be seen. Although not depicted, target decals 14 are also attachable to target tabs 16 although some shooters may elect to use each tab 16 as a whole as a target in view of its relatively small size. Shooters may elect to place target decals on either the front or reverse sides, or both, of target tabs 16 because disc 12*a* can be controlled to rotate in either direction.

The three (3) apertures in the center of disc 12*a* in FIGS. 1A and 1B are collectively denoted 12*c*. The center aperture receives the output shaft of a DC motor that rotates disc 12*a* and the outlying apertures are used to mount disc 12*a* to a support member disclosed hereinafter.

Figure 1D:
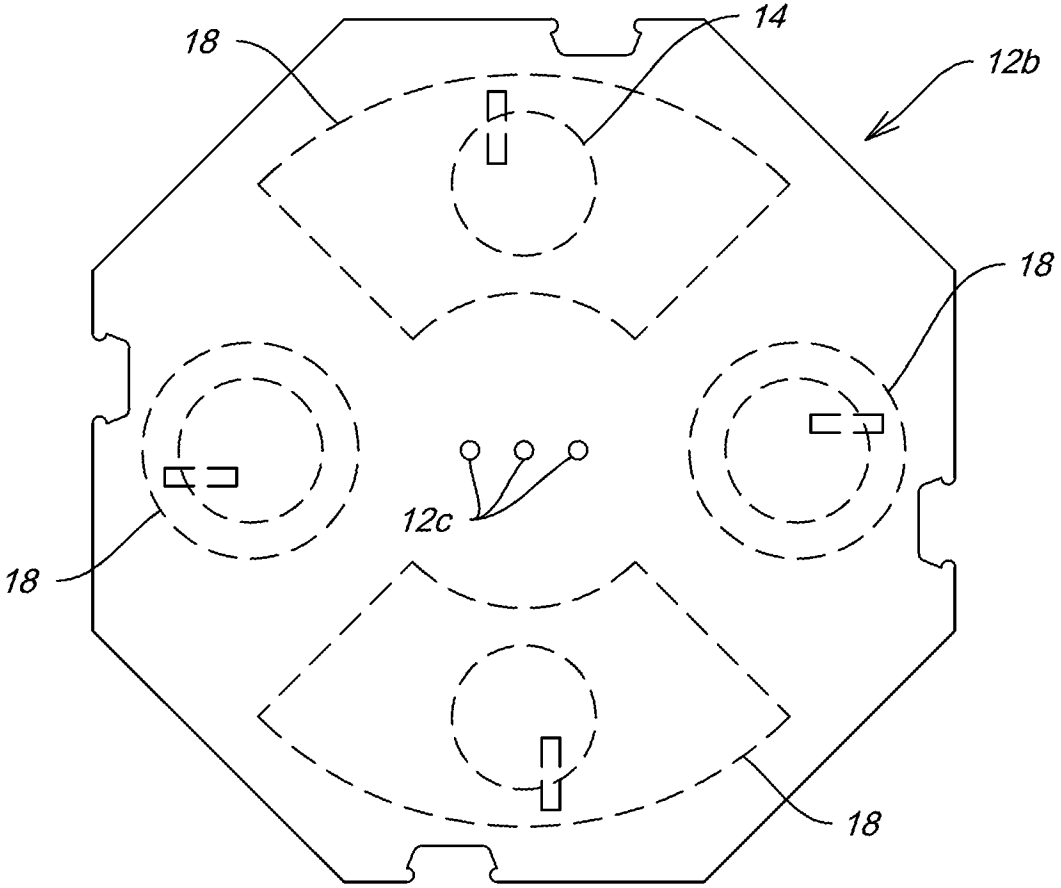
FIG. 1D is a front elevation view of a blocker disc prior to removal of its perforated windows.

System 10 further includes at least one non-rotating, blocker disc 12*b*, depicted in FIG. 1D. Blocker disc 12*b* is mounted in front of rotating target disc 12*a*, in spaced apart, parallel relation thereto, when said disc 12*a* is oriented in the facing-the-shooter position of FIGS. 1A and 1B so that the shooter cannot see rotating target disc 12*a*. Blocker disc 12*b* serves no purpose and is not used when disc 12*a* is in its FIG. 1C on-edge position relative to the shooter.

Both discs 12*a* and 12*b* are formed, preferably, of corrugated or fluted cardboard (also known as fiberboard), cardstock, poster board and single or multiple ply paper of various thickness and density depending on the application and type and caliber of projectiles used.

Rotating target disc 12*a* and non-rotating blocker disc 12*b* may be provided in any predetermined geometrical shape such as circular but the depicted octagonal shape is preferred. It is also preferred that blocker disc 12*b* have the same shape and size as rotating target disc 12*a* but blocker disc 12*b* could be made of a shape and size that differs as long as it performs its function of blocking rotating target disc 12*a* from the shooter's view. Each disc 12*a* and 12*b* is pre-notched, pre-cut, pre-slotted and pre-drilled to facilitate its use.

Perforation lines 18 in FIG. 1D enable a user to easily remove at least one or any other quantity of the cardboard areas surrounded by said perforation lines. When a surrounded area is punched out, a window is formed in said blocker disc 12*b*. The windows may be of any quantity, size and shape, but they must be positioned so that at least one decal target 14 on rotating target disc 12*a* becomes visible when it rotates past a non-rotating window.

Figure 1E:
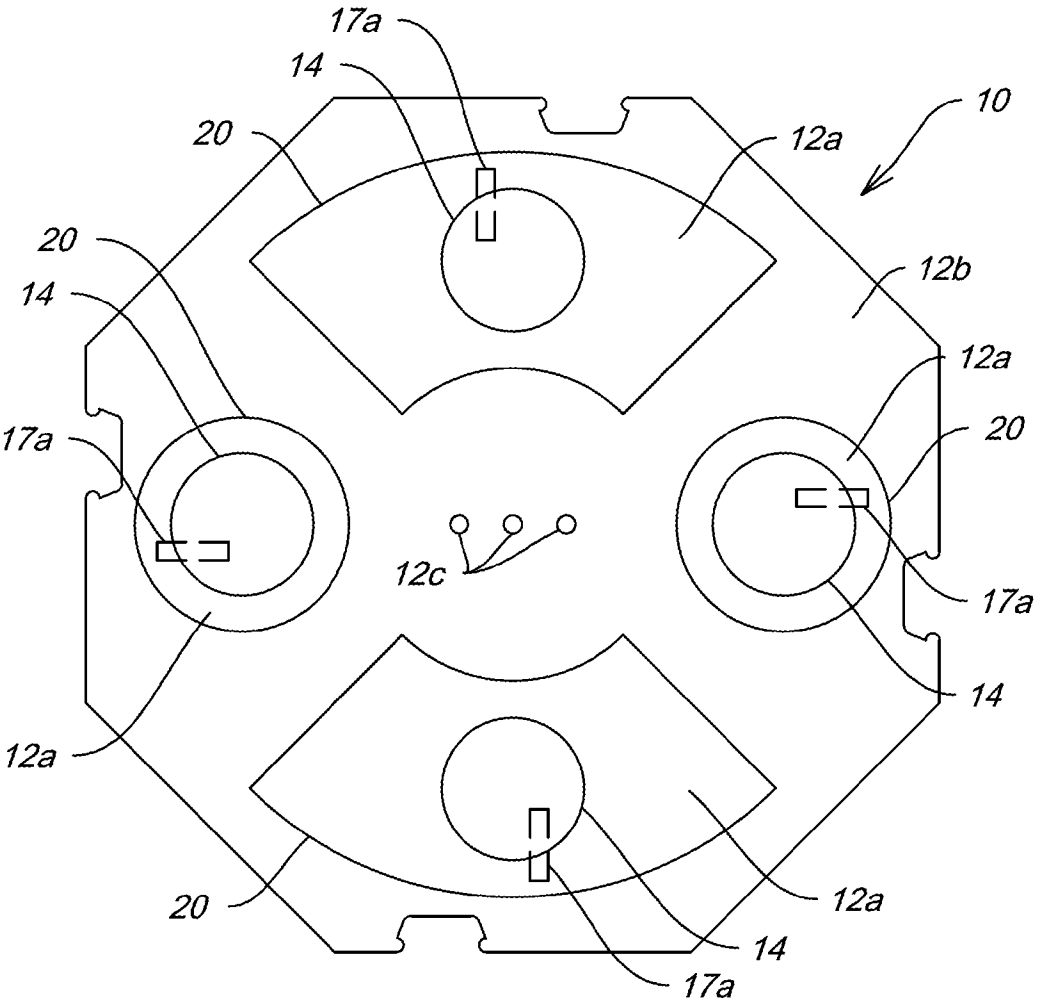
FIG. 1E is a front elevation view of the blocker disc when positioned in blocking relation to the rotating target disc and after removal of the perforated sections to form windows in said blocker disc.

FIG. 1E differs from FIG. 1D in that the perforation-surrounded areas have been removed to form windows 20 in blocker disc 12*b*, thereby revealing parts of rotating target disc 12*a* and revealing each target tab 14 when such tab rotates behind a stationary window 20. Windows 20 provide temporary visual exposure of decal targets 14 to the shooter as said decal targets travel with rotating target disk 12, i.e., windows 20 provide brief opportunities for the shooter to shoot a target decal 14 through a window. The target reappears on the following revolution of rotating target disc 12, affording the shooter the opportunity to check the accuracy of the previous shot as well as the opportunity to resume shooting.

It is within the scope of this invention to provide a blocker disc 12*b* having only one (1) window 20 formed therein but the preferred embodiment has multiple windows and one (1) or any other number of them may be punched out/removed from the blocker disc, depending upon the selection of the user. From the shooter's view point, windows 20 cause the rotating decals 14 to momentarily appear when aligned with a window and to disappear as rotating target disc 12*a* continues to rotate, thereby closing each window of opportunity for the rotating decal 14 to be hit with a projectile.

Figure 2A:
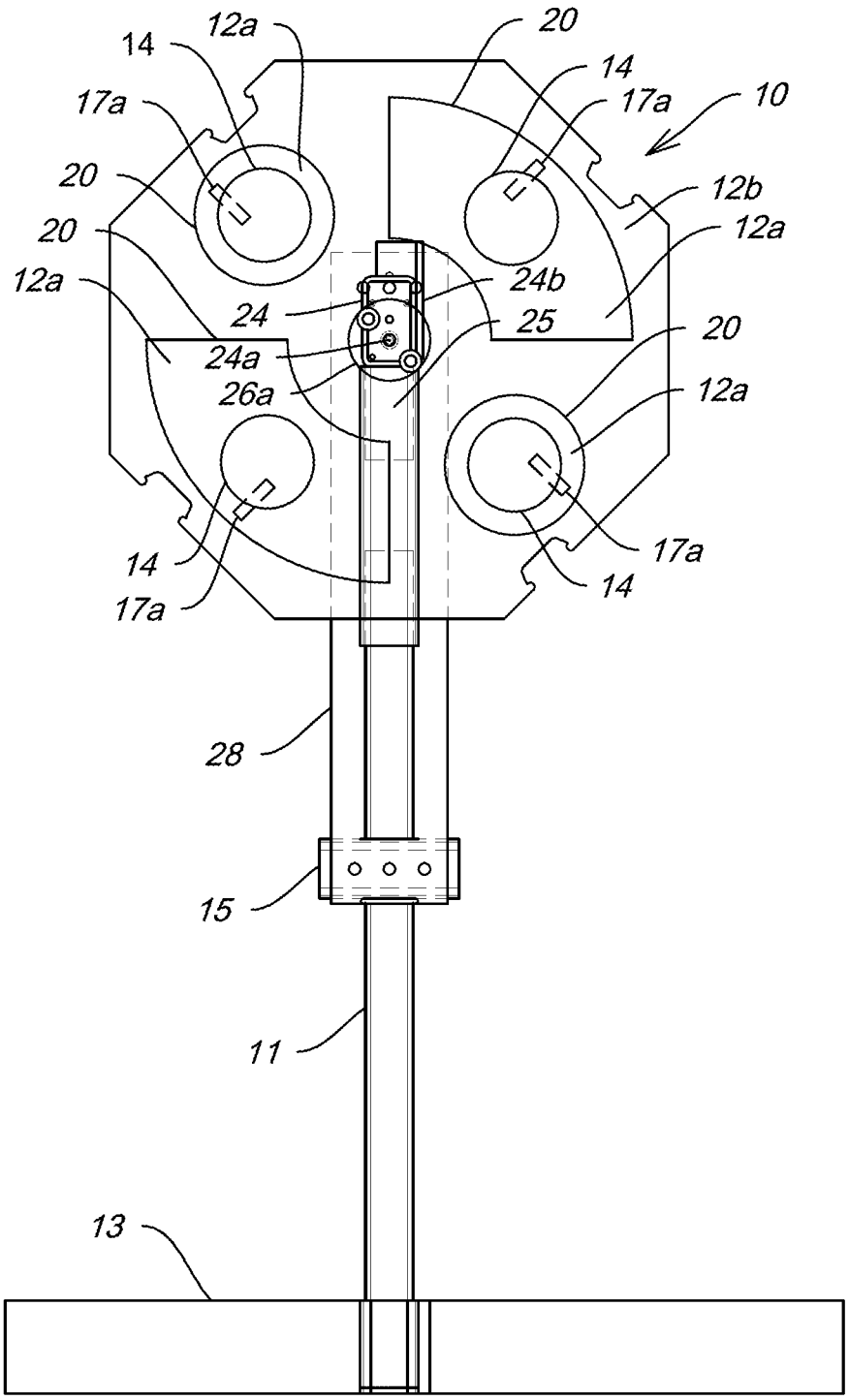
FIG. 2A is a front elevation view of the novel assembly when configured to have one rotating target disc and associated non-rotating blocker disc in a front vertical configuration.
Figure 2B:
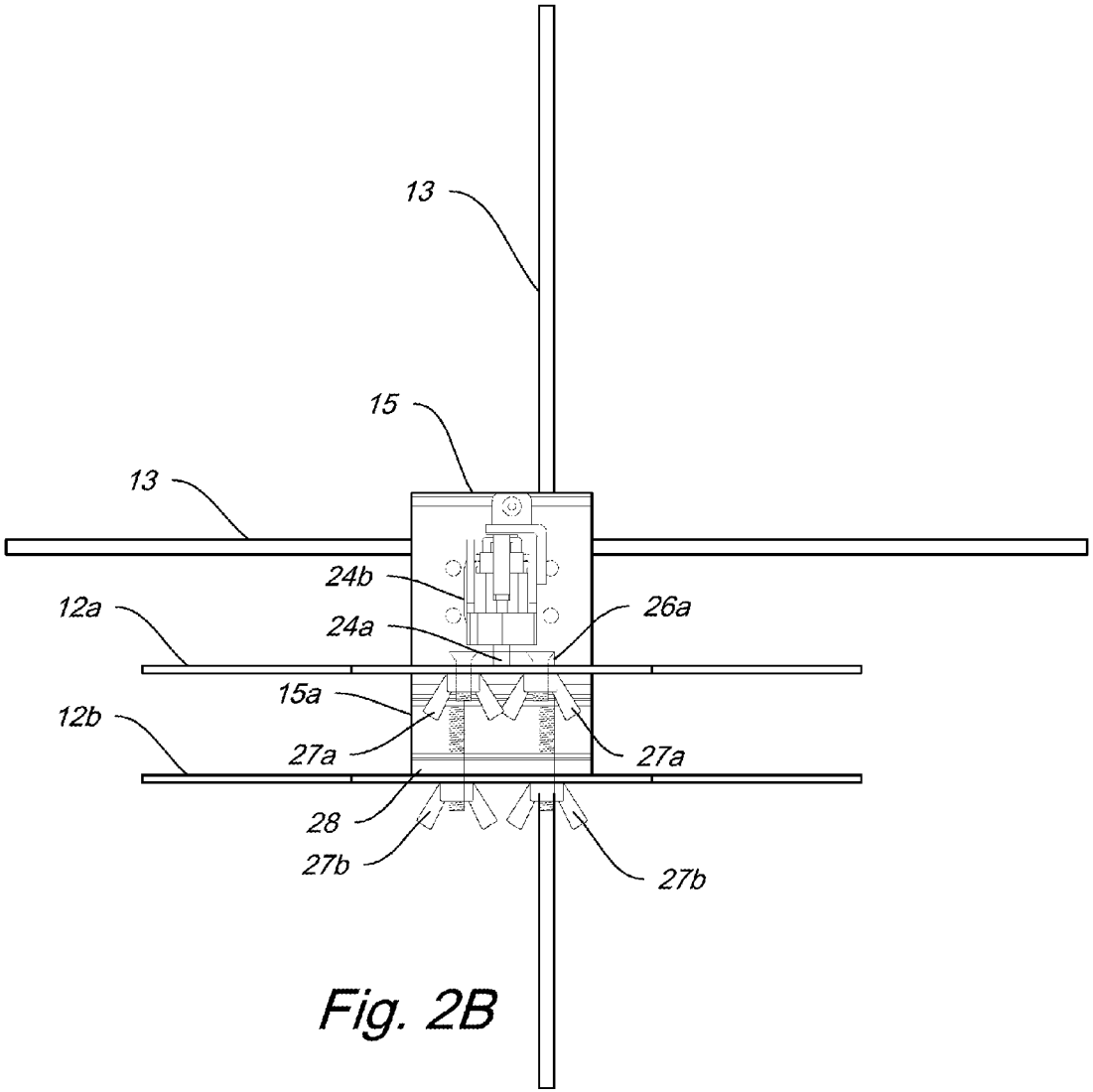
FIG. 2B is a top plan view of the parts depicted in FIG. 2A.
Figure 2C:
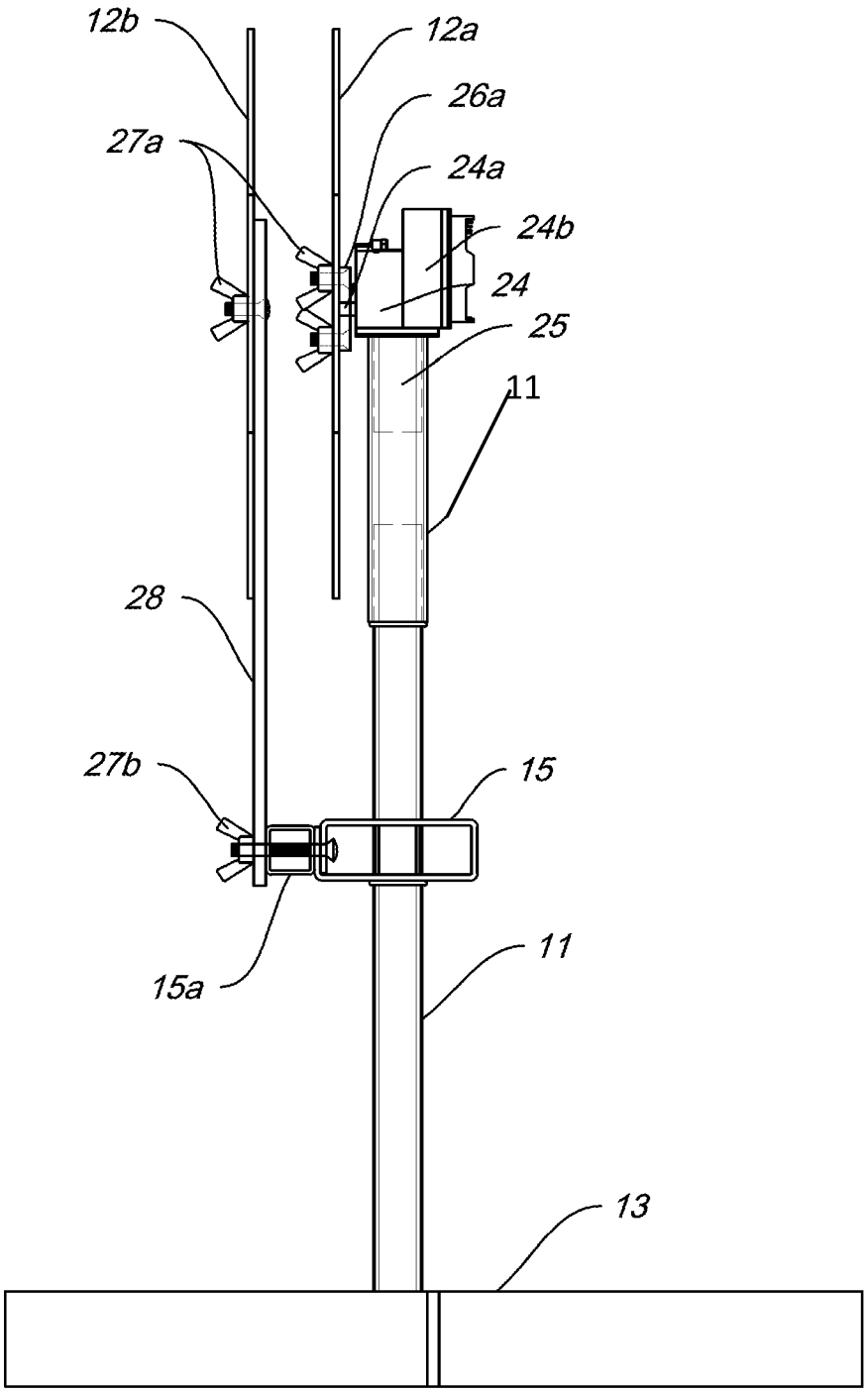
FIG. 2C is a side elevation view of the parts depicted in FIGS. 2A and 2B.

In the illustrative embodiment of FIGS. 2A, 2B, and 2C, discs 12*a* and 12*b* are mounted to the uppermost end of vertical support column 11 which is hollow and preferably square in transverse section, and preferably of telescoping construction as well so that its vertical extent is adjustable. Vertical, telescoping columns that may be locked into any preselected position of height adjustment are well-known so the locking means is not depicted in order to avoid needless cluttering of the drawings. The lowermost end of vertical column 11 is mounted to base 13 which may take any well-known form. In this particular example, base 13 has a plus-sign (+) shape when viewed in the plan view of FIG. 2B.

Both discs 12*a* and 12*b* are apertured as at 12*c* as mentioned and as illustrated in FIGS. 1A-E to enable attachment of said discs to plastic, polycarbonate or wooden mounting disc 26*a* (FIG. 2A, disc 12*a*) and blocker arm 28 (FIG. 2B, disc 12*b*).

Platform 15 is centrally apertured to slidingly receive vertical support column 11 and is lockable to said vertical column at any preselected position by suitable locking means. Spacer 15*a* adjacent platform 15 is best understood by comparing the side elevation view of FIG. 2C with the front and top views of FIGS. 2A and 2B. It secures blocker arm 28 against rotation as best understood in connection with said FIG. 2C.

The output shaft of DC motor 24 is denoted 24*a* in FIGS. 2A and 2B and its housing is denoted 24*b* in FIG. 2B. Housing 24*b* also houses a battery, a battery holder, wiring, toggle switches and the electrical connectors that interconnect the battery to said DC motor.

Motor mounting post 25 is formed integrally with motor 24 and motor housing 24*b*. Said post 25 is releasably and slideably received within the uppermost end of hollow vertical column 11 as depicted in FIGS. 2A-C so that target and blocker discs 12*a* and 12*b* are facing the shooter. Said post could be rotated about its vertical axis in either direction ninety degrees (90°) to present target 12*a* on edge. Blocker disc 12*b* is not used when target disc 12*a* is presented on edge to the shooter.

Moreover, an elbow member having two hollow parts disposed at a ninety degree (90°) angle to one another, disclosed hereinafter and not depicted in FIGS. 2A-C, may also be releasably and slideably received within said hollow vertical column 11 in differing orientations. Motor housing post 25 may be releasably and slideably received with the respective hollow interiors of said elbow parts, thereby providing a large number of possible configurations for the target and blocker discs.

The output shaft of motor 24 is denoted 24*a* in FIGS. 2A, 2B, and 2C. Circular mounting member 26*a*, preferably of polycarbonate construction, is mounted on said output shaft 24*a* for conjoint rotation therewith. There are two (2) diametrically opposed openings for screws formed in polycarbonate mounting member 26*a*, radially outwardly of output shaft 24*a*, and said screw openings are clearly depicted but are not numbered in order to avoid clutter. The center aperture of the three (3) apertures denoted 12*c* in the center of rotating target disc 12*a* is placed into registration with output shaft 24*a* and said two (2) screw openings are aligned with the two (2) apertures that flank said central opening when disc 12*a* is secured to mounting member 26*a* with a pair of nylon screws and wing nuts, denoted 27*a* in FIGS. 2B and 2C, that are inserted into said two (2) apertures.

Non-rotating disc 12*b* is normally secured directly to its adjacent cardboard support components with a screw and wing nuts 27*b* as best understood in connection with FIG. 2B.

Mounting member 26*a* may be formed of polycarbonate, plastic, ABS, wood or metal.

Blocker disc 12*b* has substantially the same construction as a rotating target disc 12*a* and can be used as a target disc, just as a rotating target disc 12*a* can be used as a blocker disc 12*b*. Each blacker disc 12*b* is a pre-notched, pre-cut, pre-slotted and pre-drilled section of corrugated or fluted card board (also known as fiberboard), cardstock, poster board and single or multiple ply paper of various thickness and density or circular or other predetermined geometric configuration. Corrugated or fluted card boards can also be stacked and layered to produce a more robust product for use with heavier caliber projectiles and arrows.

Blocker arm 28, mentioned above, is an elongate flat member that is vertically oriented in this particular embodiment. It is positioned behind blocker disc 12*b* but in front of target disc 12*a*, motor 24 and motor housing 24*b*. Its function is to protect said motor and motor housing from projectiles. Blocker arms 28 also serve to block the shooter's view of motor 24 and motor housing 24*b* thus indirectly helping the shooter to concentrate on the rotating target decals.

Figure 3A:
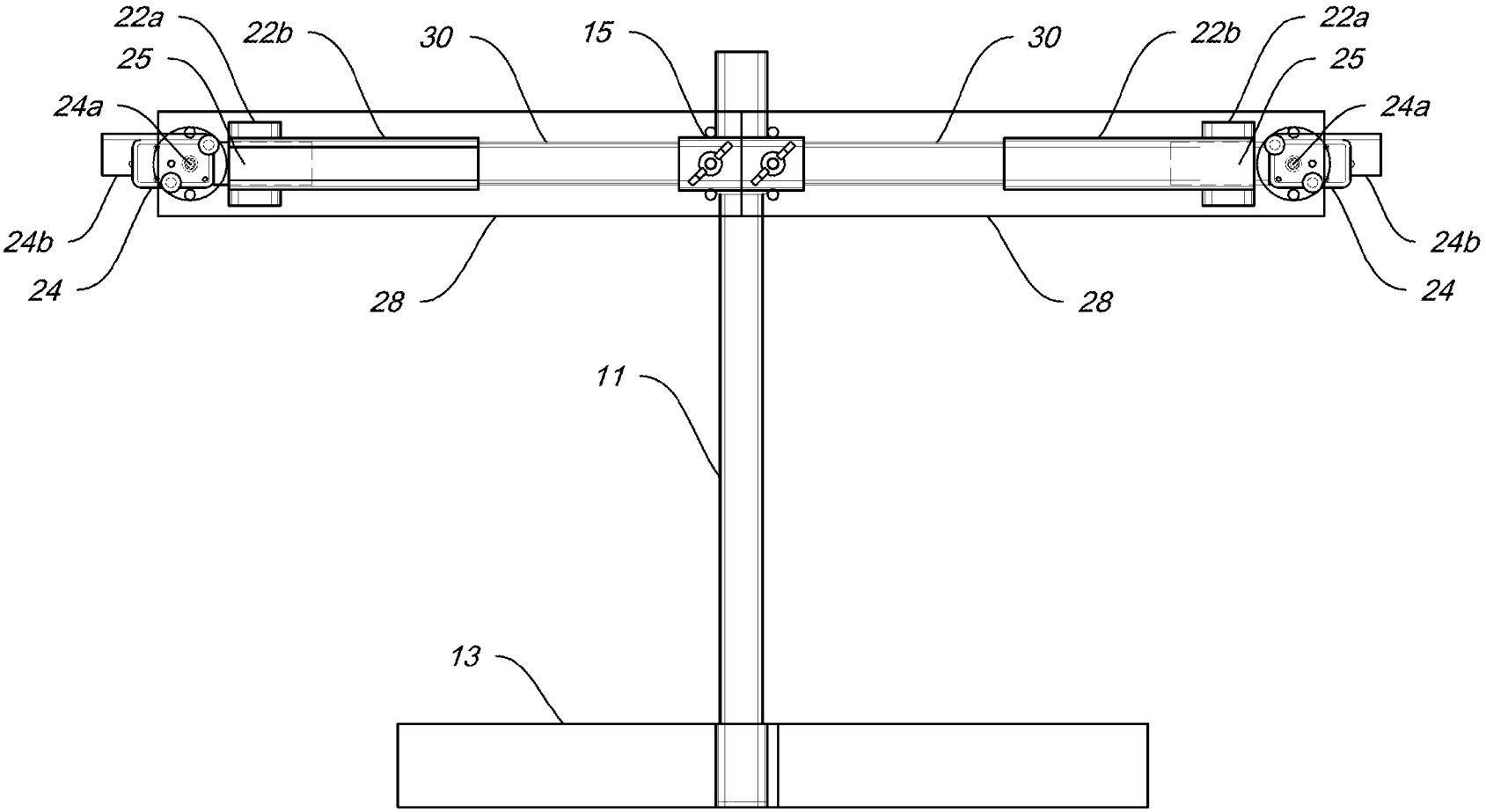
FIG. 3A is a front elevation view when the novel assembly is configured to display two rotating target discs and their associated non-rotating blocker discs in lateral relation to one another in a front vertical configuration.
Figure 3B:
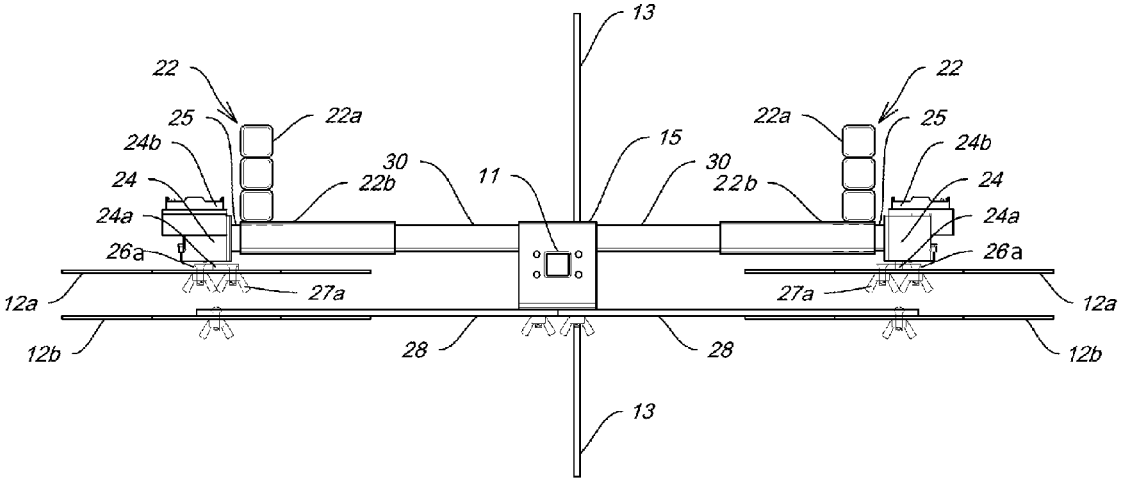
FIG. 3B is a top plan view of the parts depicted in FIG. 3A.

FIGS. 3A and 3B are front elevation and top plan views, respectively, of an arrangement where novel system 10 is arranged so that two rotating discs 12*a*, depicted in FIG. 3B but not in FIG. 3A, and their associated blocker discs 12*b*, also depicted in FIG. 3B but not in FIG. 3A, are positioned in laterally spaced apart relation to one another with adequate spacing to prevent torn pieces of still-attached cardboard, naturally produced by exiting projectiles and emerging on the reverse side of 12*b*, from contacting and interrupting the rotation of 12*a*. This allows a shooter to try to hit targets by quickly aiming to the left and to the right in alternating sequence as target discs 12*a* rotate. The rate of rotation as well as the direction of rotation may also be different for the two rotating discs 12*a*, 12*a*.

Mounting arm 30 is preferably provided in the form of a single piece of ABS plastic. It is inserted into and pushed through platform 15 so that platform 15 is mid-length of said mounting arm. Another function of platform 15 is also disclosed in FIGS. 3A and 3B. Platform 15 is hollow and enables the mounting of mounting arm 30 aforesaid so that said mounting arm 30 extends in a horizontal plane on opposite sides of vertical column 11. Targets may be secured in multiple configurations to the outboard ends of mounting arm 30. Mounting arm 30 is protected by flat blocker arms 28, 28 which are parallel to mounting arm 30 and which are positioned between the shooter and mounting arm 30. The mounting arm is square in transverse section.

Ninety degree (90°) elbow 22 is preferably formed of plastic square tubing. This elbow shape enables motor output shaft 24*a* and therefore discs 12*a* and 12*b* to be positioned in multiple orientations.

Motor housing post 25 which is square in transverse cross section is releasably and slideably received within vertical column 11 which is also square in transverse section in the embodiment of FIGS. 2A-C as disclosed above. In many other embodiments, said post is received within elbow part 22*a* or 22*b*, and said elbow parts are in turn received within vertical column 11 or within mounting arm 30. Vertical column 11 and mounting arm 30 are slideably received within the elbow parts.

There are two (2) elbow members 22 in the configuration depicted in FIGS. 3A and 3B. First part 22*a* extends into the plane of the paper in FIG. 3A as best understood in the top plan view of FIG. 3B. Second part 22*b* thereof is disposed in ensleeving engagement with its associated platform mounting arm 30. Motor housing post 25 is releasably and slideably received within the hollow interior of elbow part 22*b*.

Accordingly, elbow parts 22*a* are superfluous in this particular arrangement because motor housing posts 25, 25 can be inserted directly into the hollow interiors of elbow parts 22*b*.

The square-in-transverse-section of vertical column 11, each motor housing post 25, mounting arm 30, and each elbow part 22*a*, 22*b*, enables multiple interconnections of said part 30 and thus enables the output shaft 24*a* of each motor 24 to be oriented in multiple configurations.

FIG. 3B in particular demonstrates that motor housing post 25 can be releasably and slideably received within the hollow interior of elbow part 22*a* so that motor output shaft 24*a* would extend out of the plane of the paper or into the plane of the paper in said FIG. 3B, and that each elbow part 22*a* could be rotated from its FIG. 3B position relative to mounting arm 30 into three (3) additional positions.

More particularly, elbow part 22*a* in FIG. 3B can be rotated ninety degrees (90°) from its depicted position so that it extends into the plane of the paper, another ninety degrees (90°) so that it is positioned in the plane of the paper but extending downwardly instead of its upward extension as depicted, and another ninety degrees (90°) so that it extends upwardly from the plane of the paper.

As depicted in FIG. 3B, each blocker disk 12*b* is releasably mounted on its associated blocker arm 28. Although a screw and wing nut is depicted, such mounting may also be accomplished by VELCRO® hook and loop fastening means or other releasable fastening means.

A pre-drilled hole near the free end of each blocker arm 28 enables the shooter to attach a blocker disc 12*b* in a stationary position in front of an associated rotating target disk 12*a* to temporarily block the shooter's view of rotating decal targets 14 as aforesaid.

Each elbow section 22*b* may slideably receive mounting arm 30 at its inboard end as mentioned above and each elbow section 22*b* may slideably receives motor housing post 25 at its outboard end. Where each mounting arm 30 is square or otherwise non-round in transverse section and where each elbow part 22*b* is also square or otherwise non-round in transverse section to slidingly and non-rotatably mate therewith, elbow 22 may be attached to the platform mounting arm 30 in four (4) different positions, only one (1) of which is depicted in FIGS. 3A and 3B.

Where post 25 is also square or otherwise non-round in transverse section, motor housing 24*b* and hence motor 24 and its output shaft 24*a* can also be rotated relative to elbow part 22*b* in the same way. Moreover, post 25 can be slideably removed from elbow part 22*b* and slideably connected instead to elbow part 22*a* and it may be further rotated in the same way relative to said elbow part 22*a*, all of which will become clearer as this disclosure continues.

Figure 4A:
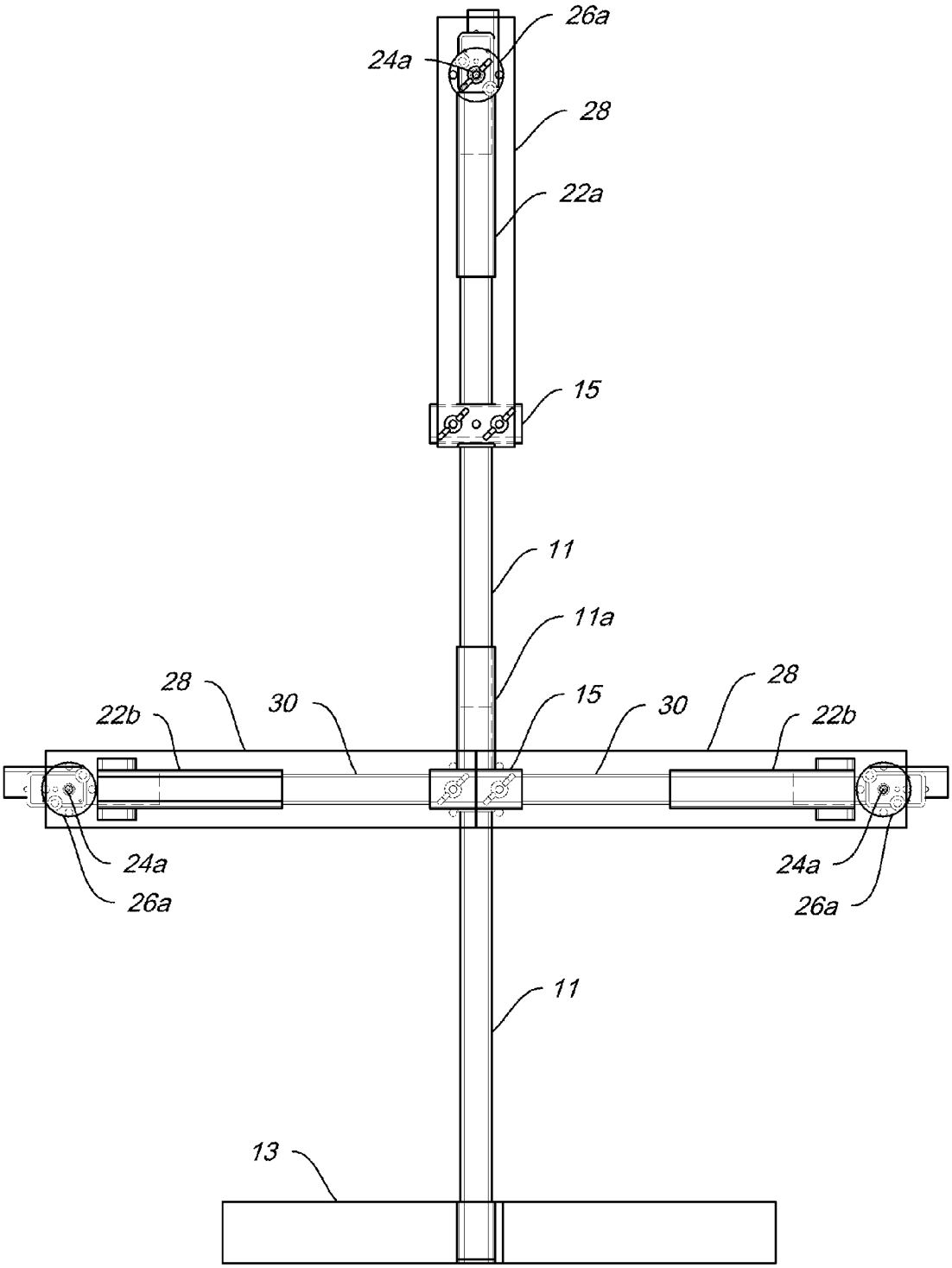
FIG. 4A is a front elevation view of the novel assembly when configured to display three rotating target discs and associated non-rotating blocker discs in a front vertical configuration.
Figure 4B:
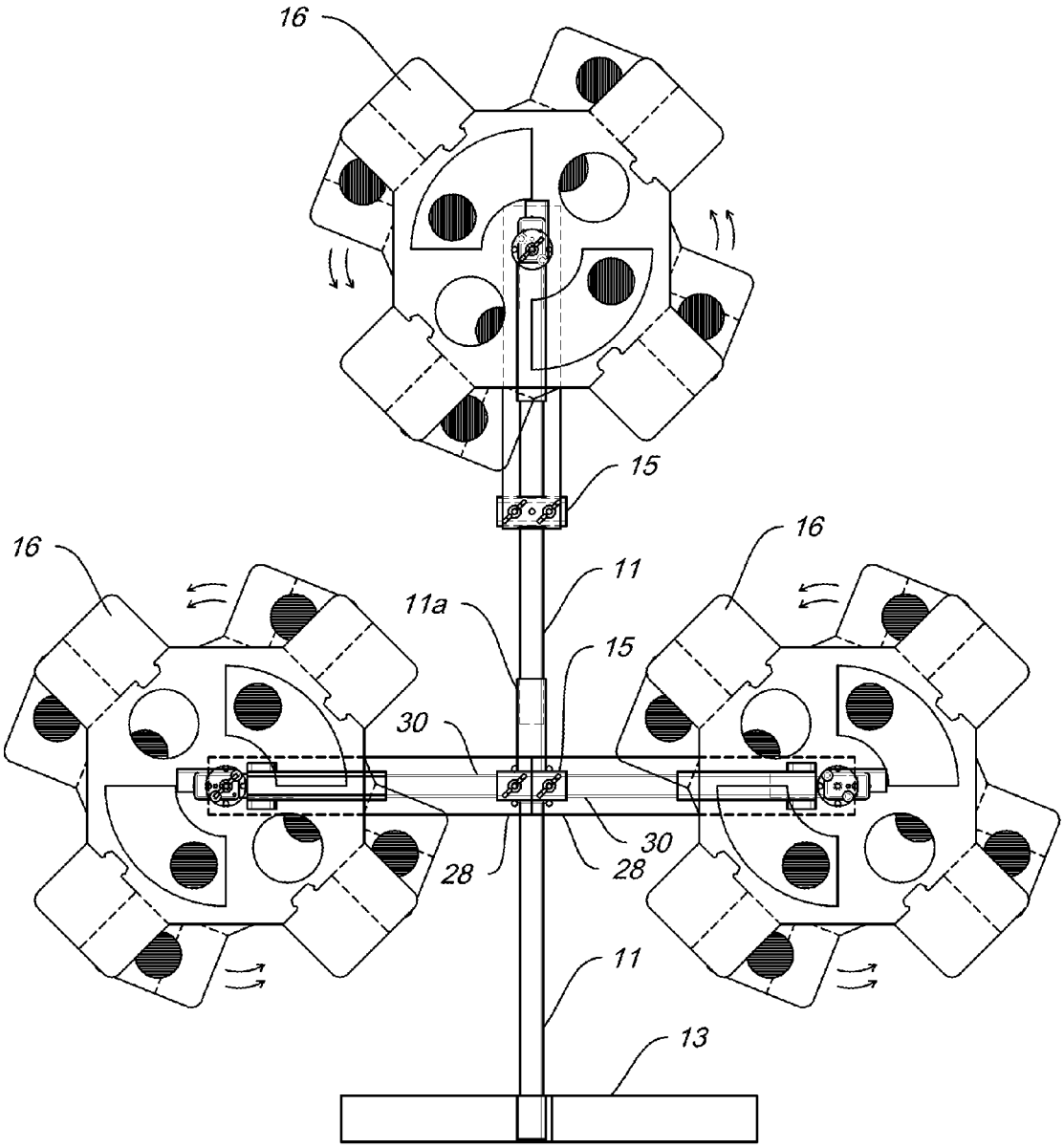
FIG. 4B is substantially the same as FIG. 4A but with the rotating and non-rotating discs attached.
Figure 5A:
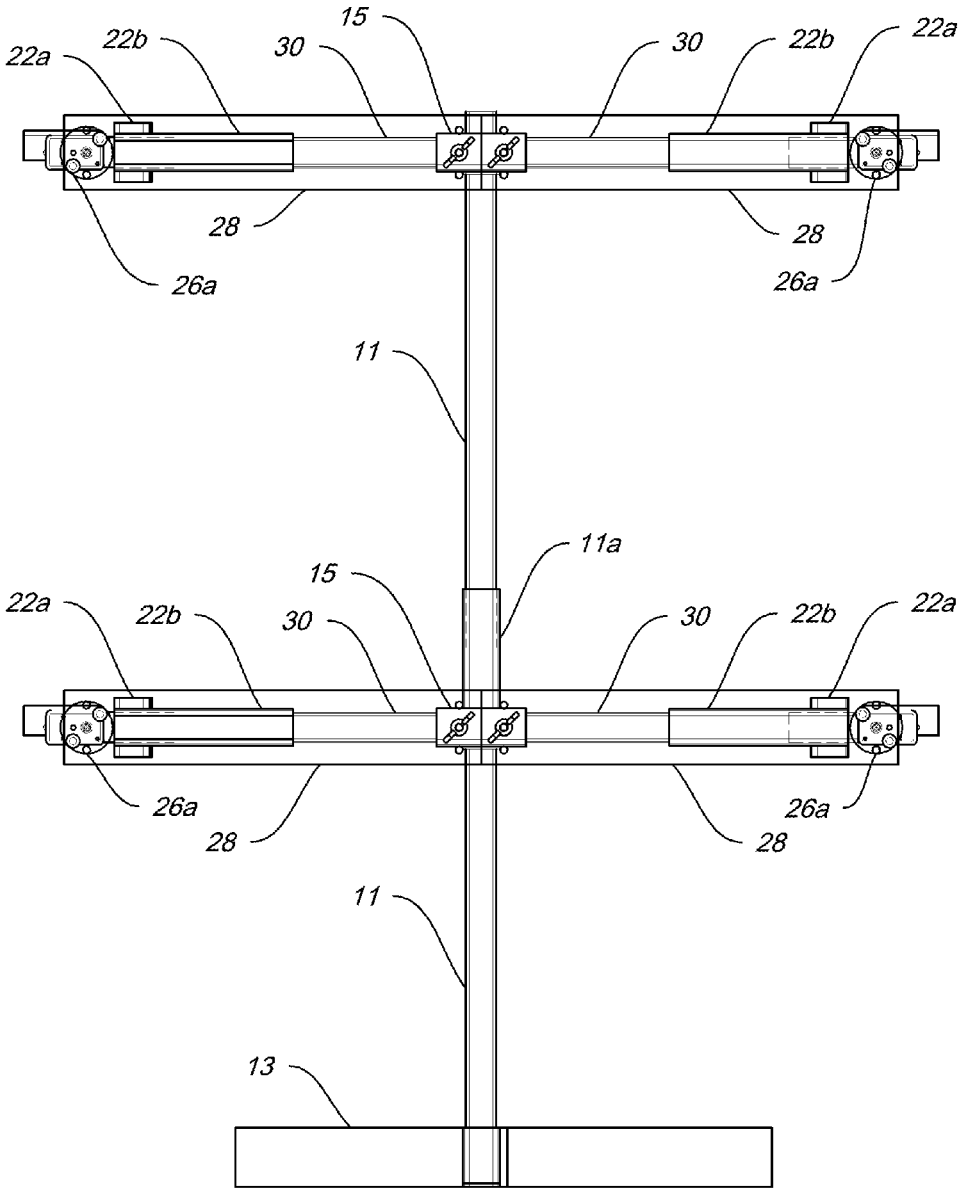
FIG. 5A is a front elevation view of the novel assembly when configured to display four (4) sets of rotating target discs and associated non-rotating blocker discs in front elevation relative to a shooter.
Figure 5B:
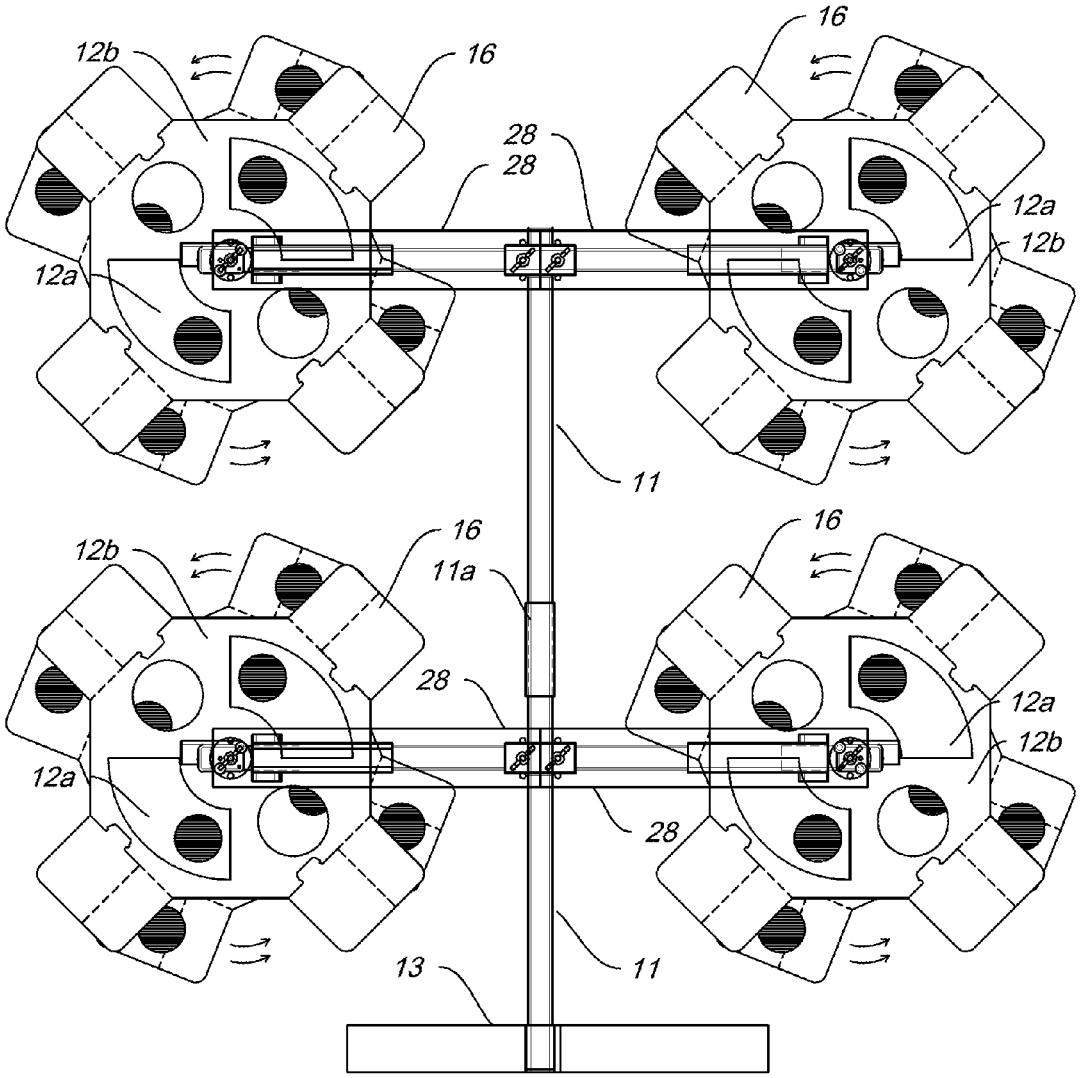
FIG. 5B is substantially the same view as FIG. 5A but with the rotating target discs and non-rotating blocker discs attached.
Figure 6A:
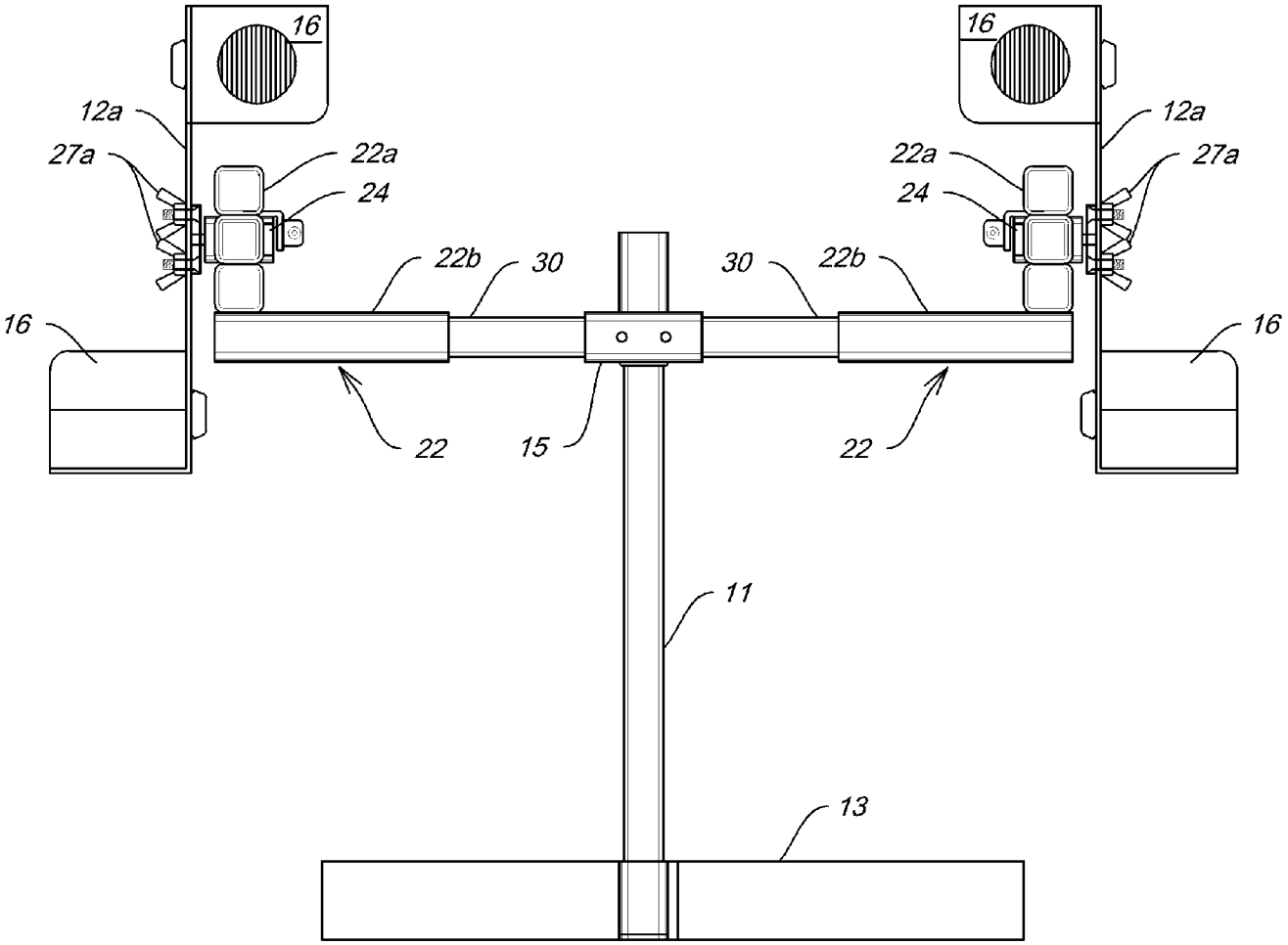
FIG. 6A is a front elevation view of the novel assembly when two laterally disposed rotating target discs are disposed in end vertical configuration relative to a shooter, there being no non-rotating blocker discs in such configuration.
Figure 6B:
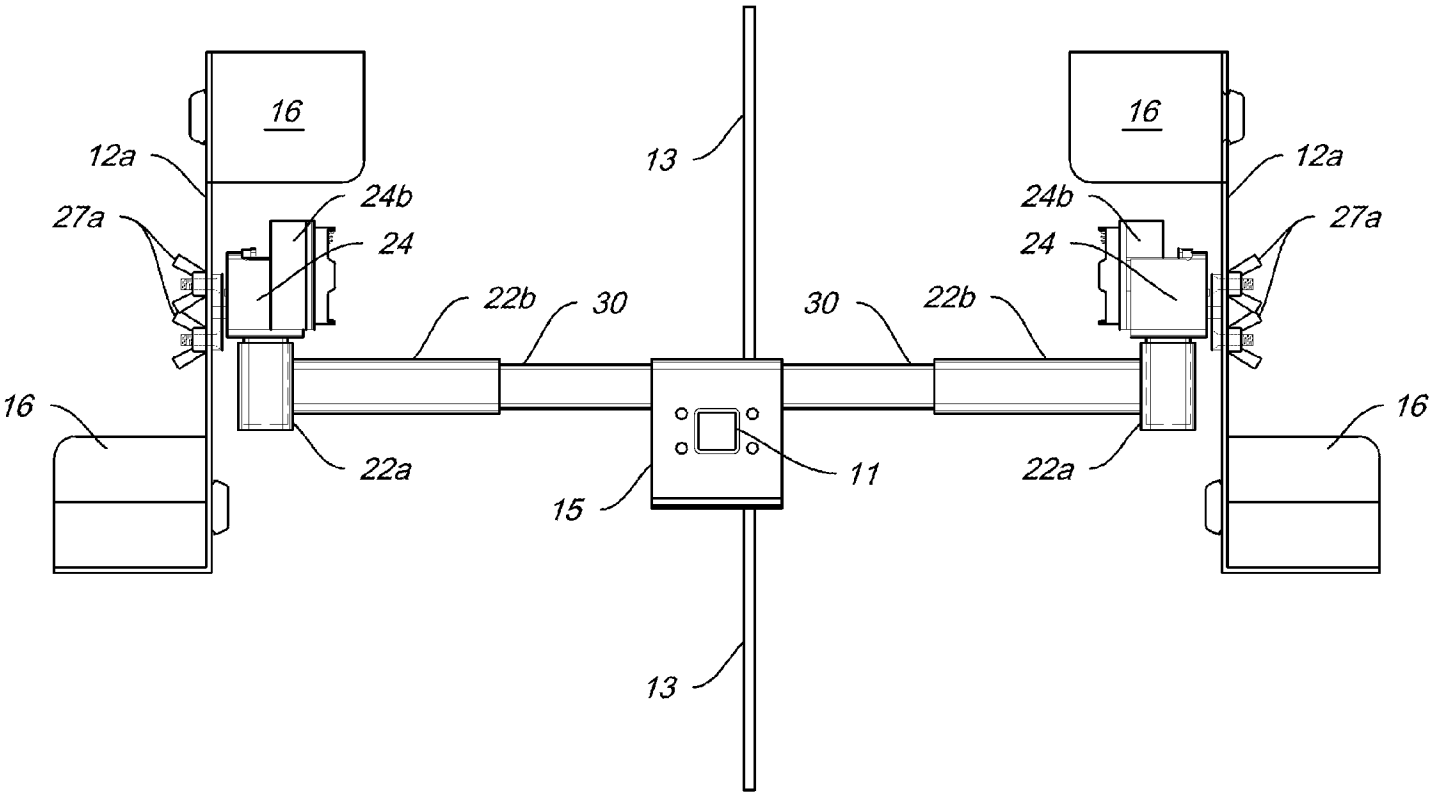
FIG. 6B is a top plan view of the structure depicted in FIG. 6A.
Figure 7A:
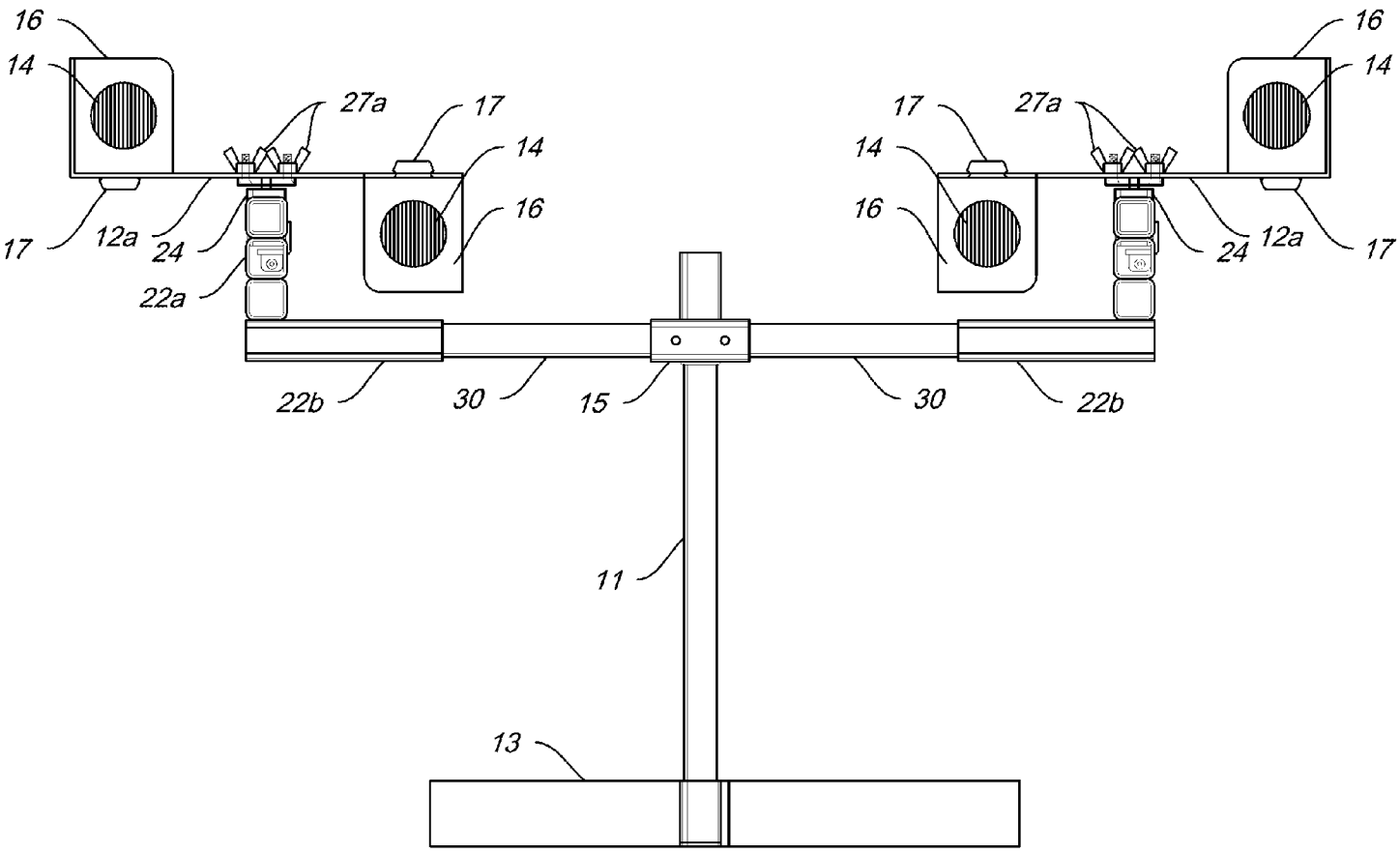
FIG. 7A is a front elevation view of the novel assembly when two laterally disposed rotating target discs are disposed in end horizontal configuration relative to a shooter, there being no non-rotating blocker discs in such configuration.
Figure 7B:
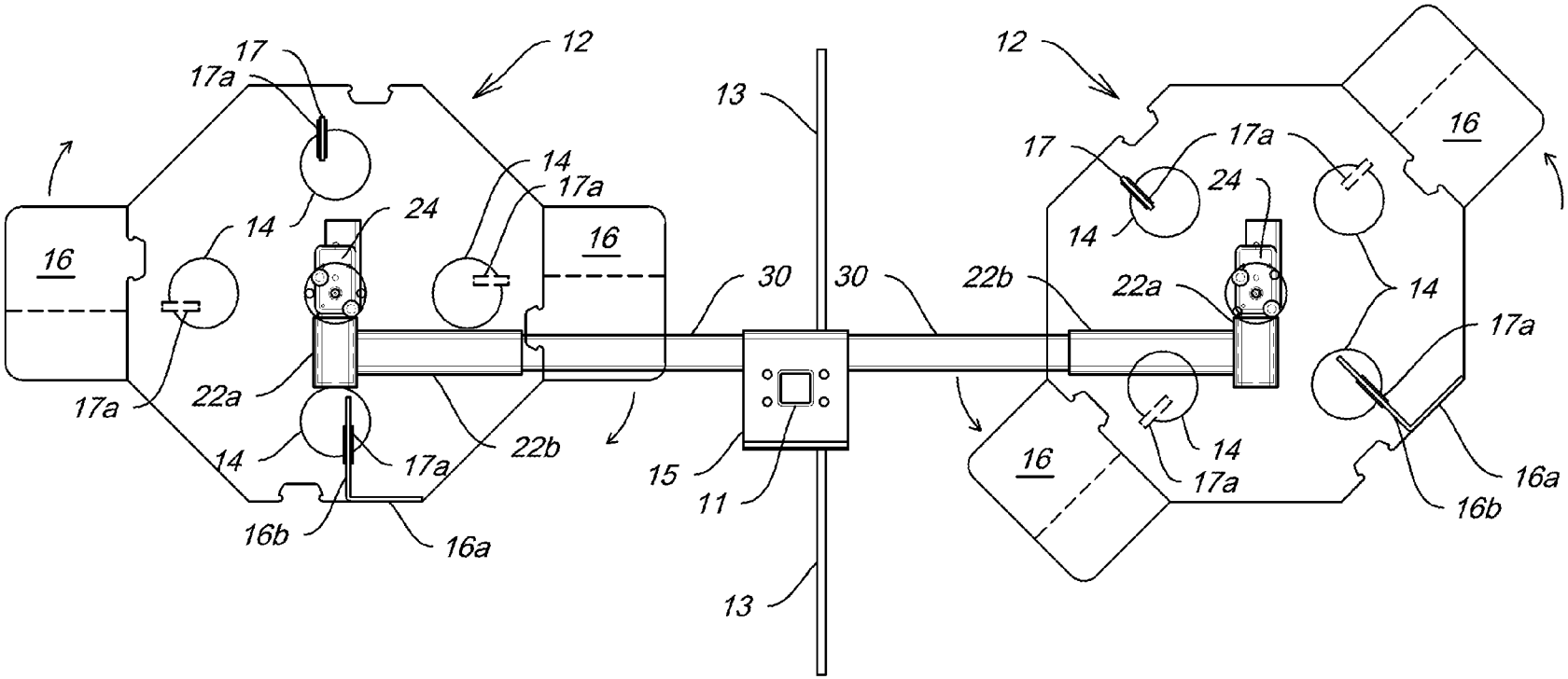
FIG. 7B is a top plan view of the structure depicted in FIG. 7A.
Figure 8A:
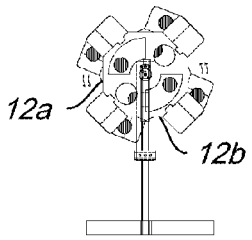
FIG. 8A is a front elevation depicting a configuration of the novel parts when one (1) target disc is used.
Figure 8B:
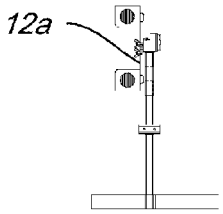
FIG. 8B is a front elevation depicting a configuration of the novel parts when one (1) target disc is used.
Figure 8C:
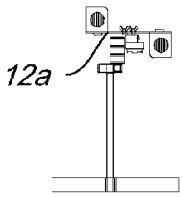
FIG. 8C is a front elevation depicting a configuration of the novel parts when one (1) target disc is used.
Figure 9A:
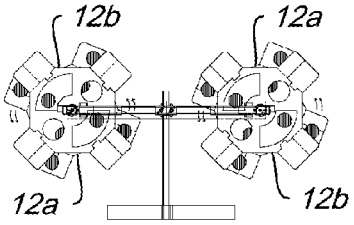
FIG. 9A is a front elevation depicting a configuration of the novel parts when two (2) target discs are used.
Figure 9B:
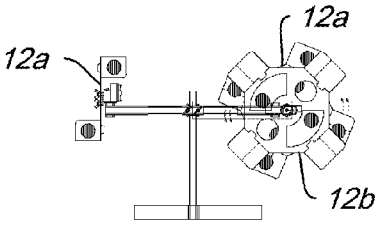
FIG. 9B is a front elevation depicting a configuration of the novel parts when two (2) target discs are used.
Figure 9C:
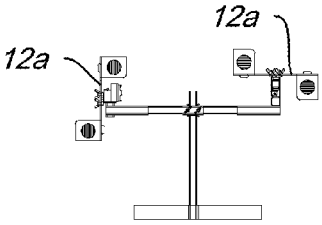
FIG. 9C is a front elevation depicting a configuration of the novel parts when two (2) target discs are used.
Figure 10A:
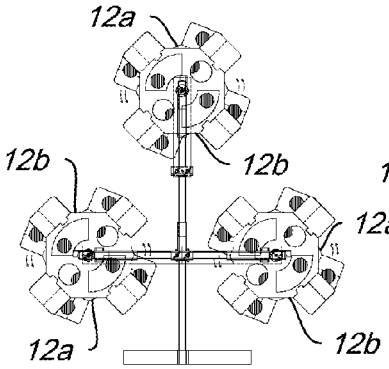
FIG. 10A is a front elevation depicting a configuration of the novel parts when three (3) target discs are used.
Figure 10B:
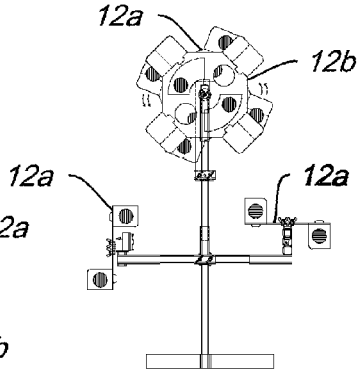
FIG. 10B is a front elevation depicting a configuration of the novel parts when three (3) target discs are used.
Figure 10C:
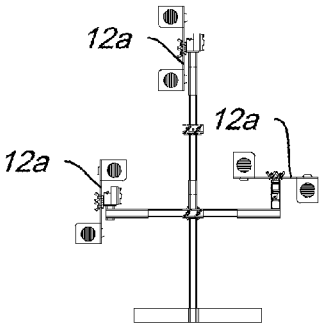
FIG. 10C is a front elevation depicting a configuration of the novel parts when three (3) target discs are used.
Figure 11A:
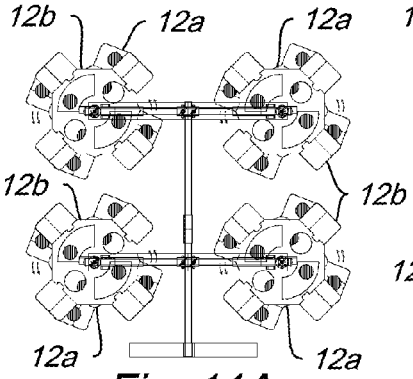
FIG. 11A is a front elevation depicting a configuration of the novel parts when four (4) target discs are used.
Figure 11B:
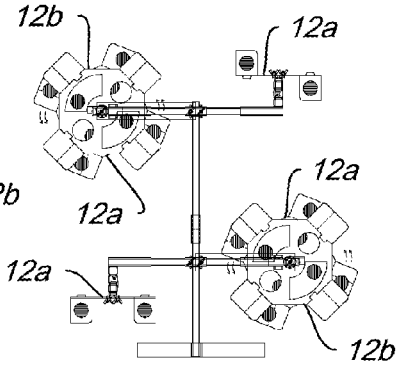
FIG. 11B is a front elevation depicting a configuration of the novel parts when four (4) target discs are used.
Figure 11C:
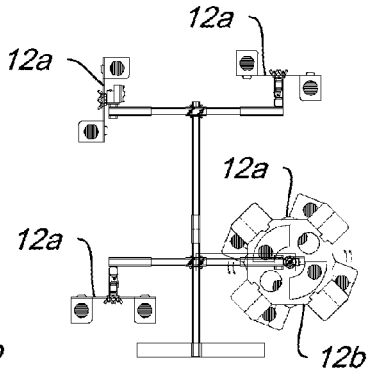
FIG. 11C is a front elevation depicting a configuration of the novel parts when four (4) target discs are used.

Elbow 22 thus enables rotating target disk 12*a* and blocker disc 12*b* to be positioned in multiple orientations, such as front view orientation as depicted in FIGS. 3A, 3B, 4A, 4B, 5A and 5B, an end view vertical orientation as depicted in FIGS. 6A and 6B, or an end view of a horizontal orientation as depicted in FIGS. 7A and 7B.

FIGS. 8A-C, 9A-C, 10A-C and 11A-C provide examples of possible configurations using one, two, three, and four targets, respectively. The multi-combination position of the DC motor configuration and rotating target disks serve to further challenge the skills of the shooter.

Elbow 22 and motor housing post 25 are quickly and easily removed by hand and positioned into a preselected orientation, thus enabling the shooter to tailor the configuration of system 10 into said front-vertical, edge-vertical and edge-horizontal orientations.

In the vertical orientations, rotating target disc 12*a* rotates in a vertical plane about a horizontal axis and the shooter has either a frontal view of the target which requires no target tabs 16 or an edge view thereof which does require said target tabs. In the horizontal orientation, rotating target disc 12*a* rotates in a horizontal plane about a vertical axis and therefore target tabs 16 are required.

The speed and the direction of revolution of rotating target disk 12*a* is regulated by a controller positioned between the battery and motor 24.

The size of each rotating target disc 12*a* may be decreased or increased and the shape of each target decal 14 may be changed to any predetermined geometrical configuration. The size of each window 20 formed in blocker disc 12*b* may be increased or decreased, and the geometrical configuration of each window may be changed. The direction of rotation of rotating target disk 12*a* may be changed. Moreover, the distance between the shooter and said rotating target disc may be changed.

An arrangement of parts that essentially combines the arrangement of FIG. 1A and that of FIGS. 3A and 3B is depicted in FIGS. 4A and 4B. This arrangement provides the two laterally-spaced apart targets of FIGS. 3A and 3B and includes a second vertical column 11*a* that is surmounted by a single target. This arrangement of parts further challenges the shooter relative to the challenge provided by the two-target embodiment of FIGS. 3A and 3B.

Figure 5C:
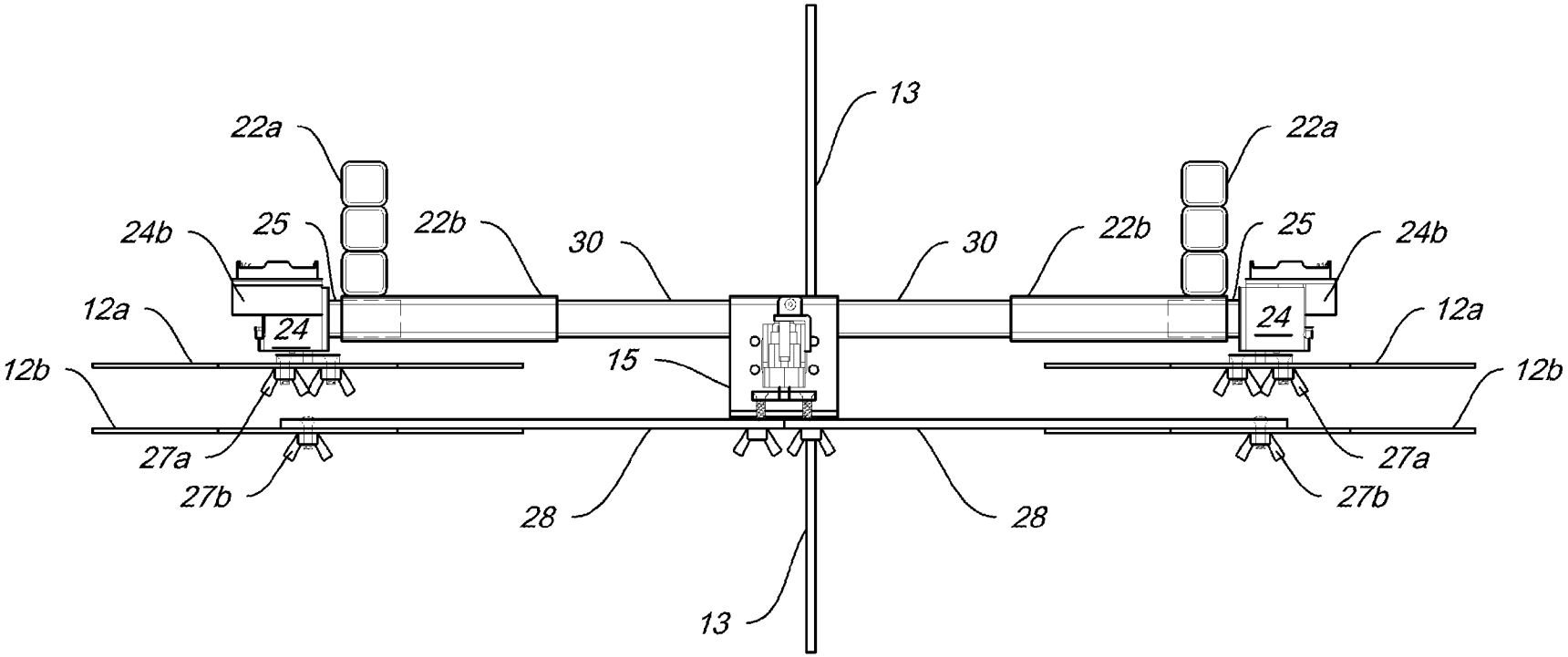
FIG. 5C is a top plan view of the structure depicted in FIG. 5B.

An arrangement of parts that adds a second set of laterally spaced apart targets is depicted in FIGS. 5A, 5B, and 5C. This arrangement includes a second vertical column 11*a* like the embodiment of FIGS. 4A and 4B but replaces the single top target with a second pair of laterally spaced apart targets, thereby providing four (4) targets to still further challenge the shooter. The embodiment of FIGS. 5A-C is essentially the same as the embodiment of FIGS. 3A and 3B, there being a second set of laterally spaced apart targets in the embodiment of FIGS. 5A-C.

FIGS. 6A and 6B disclose an arrangement of two laterally spaced apart targets, both of which are on edge to the shooter and thus require target tabs 16. Both targets in this arrangement rotate in a vertical plane about a horizontal axis. No blocker discs 12*b* are needed when targets discs 12*a* are presented on edge to the shooter as depicted.

Yet another configuration indicating the large number of differing configurations that may be provided by this novel system is depicted in FIGS. 7A and 7B. Two laterally spaced apart target discs 12*a* are mounted about a vertical axis for rotation in a horizontal plane so tabs 16 are needed as depicted. Note that for each rotating target disc 12*a*, only two (2) tabs 16, 16 are normally mounted in perpendicular relation to the plane of said target discs.

FIGS. 8A-C, 9A-C, 10A-C and 11A-C depict various configurations made with this invention as mentioned above. Note that blocker disc 12*b* is not used whenever target disc 12*a* is presented on edge to the shooter as mentioned above.

Figure 12A:
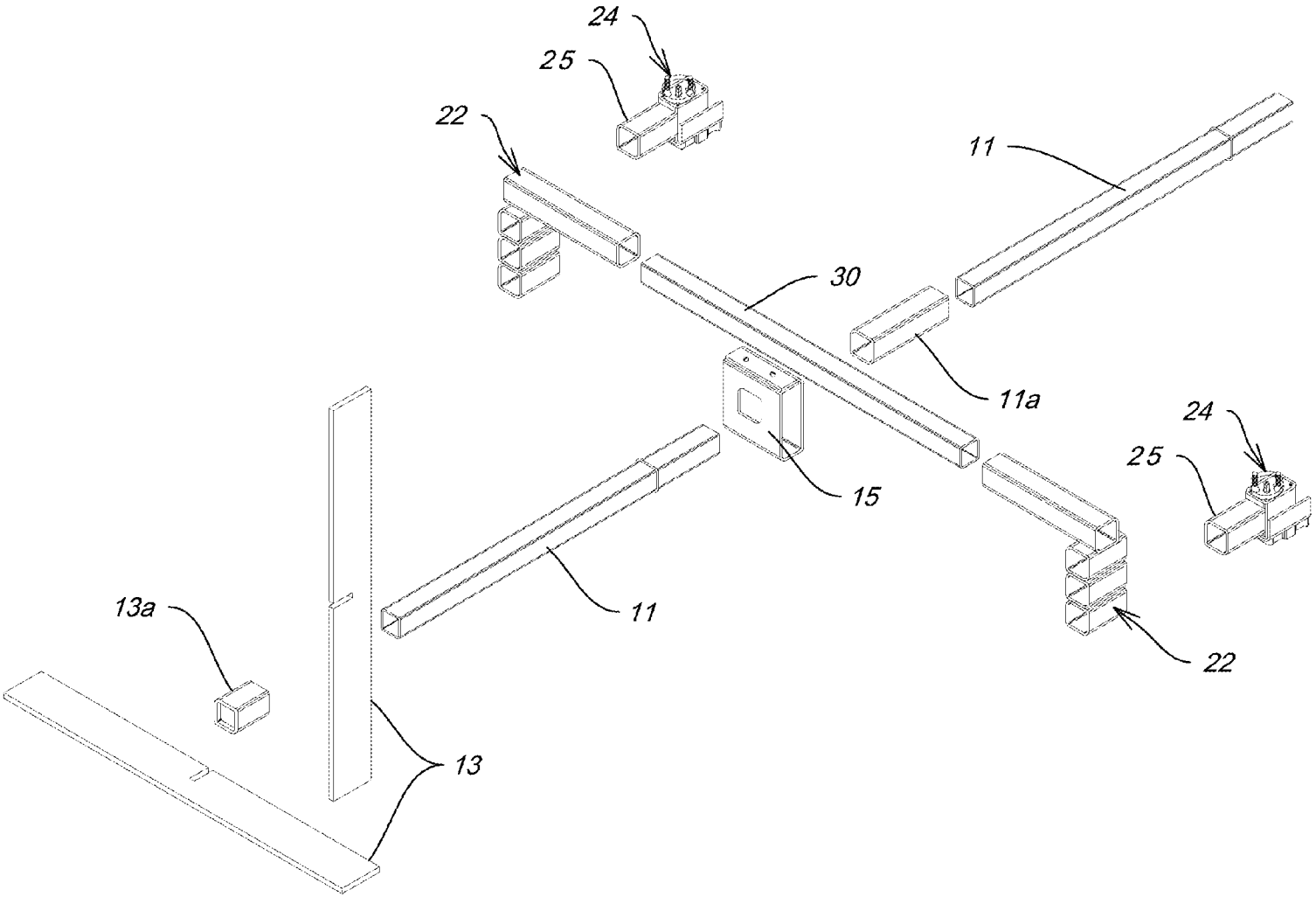
FIG. 12A is an exploded perspective view of the frame assembly.
Figure 12B:
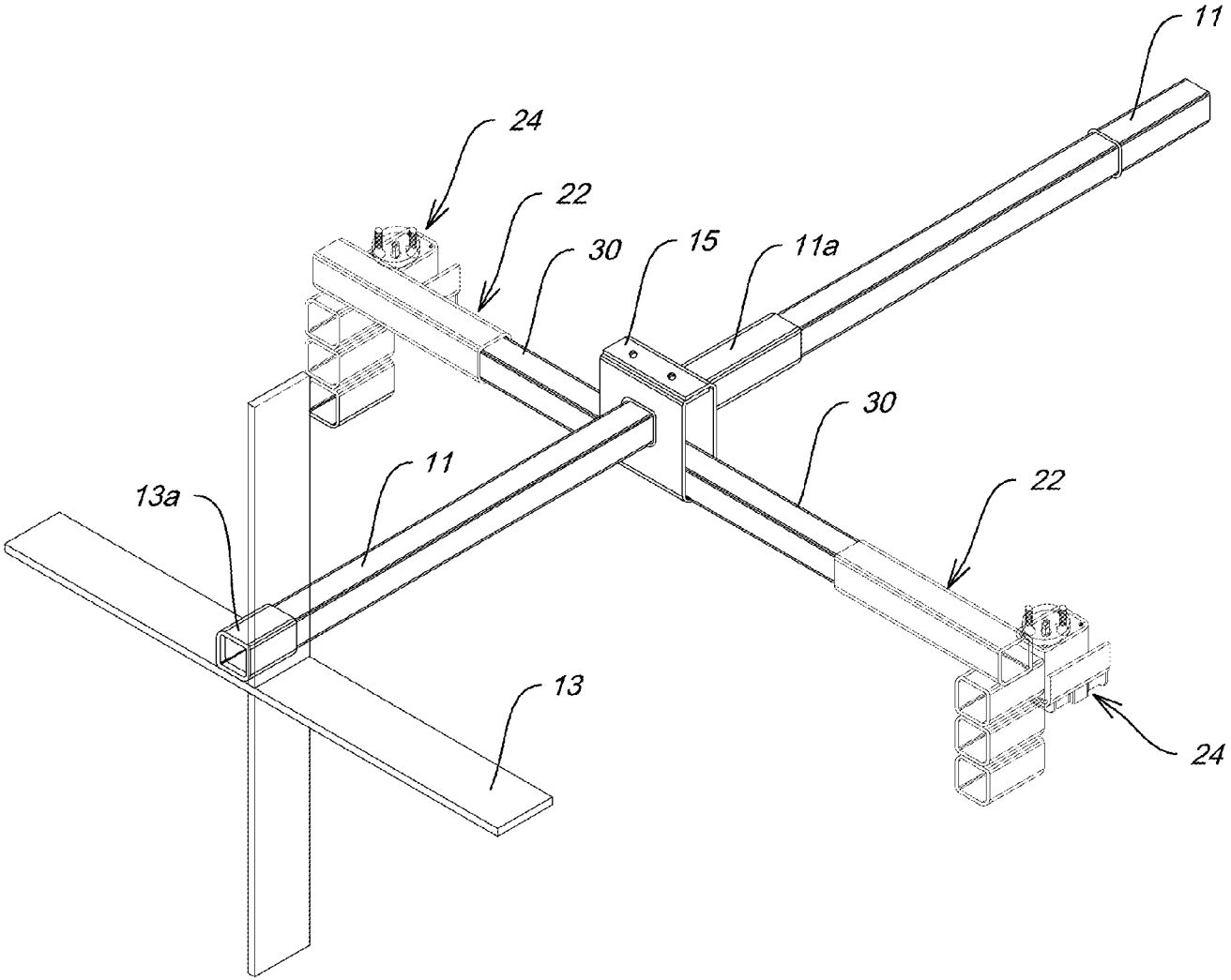
FIG. 12B is an assembled perspective view of the parts depicted in FIG. 12A.

FIG. 12A depicts the base assembly in exploded form and FIG. 12B depicts it in assembled form. Rubber-type grommets, not depicted, are placed on vertical column 11 to maintain platform 15 in a pre-selected position.

Figure 12C:
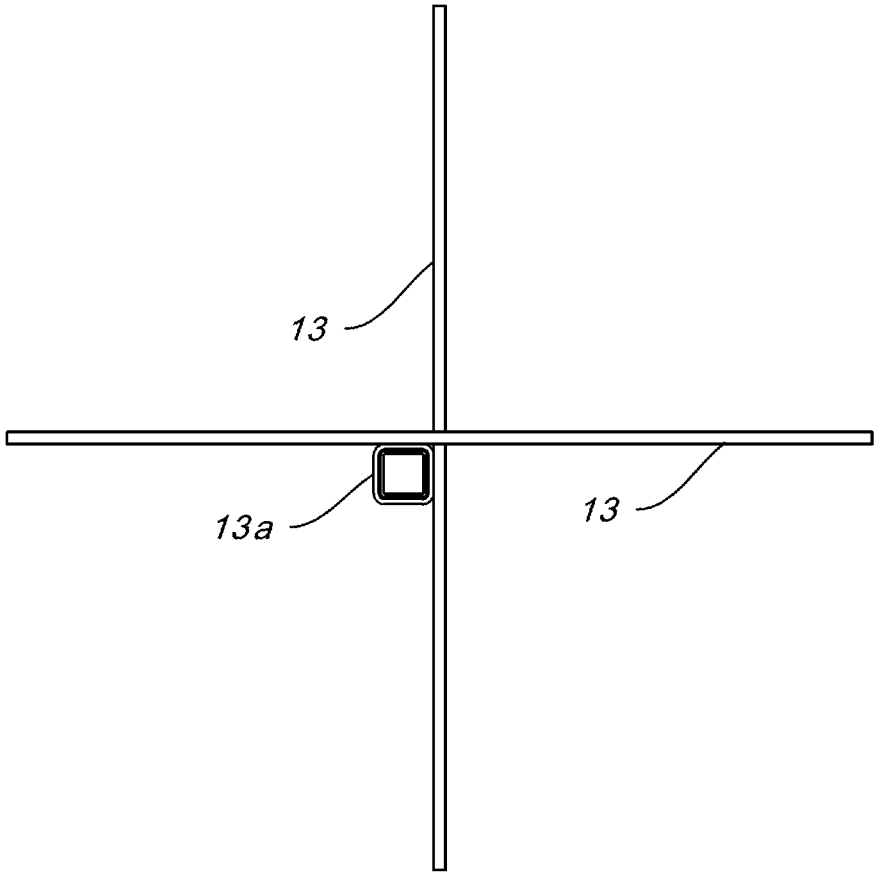
FIG. 12C is a plan view of the base assembly.

FIG. 12C is a plan view that best shows why post 11 is offset with respect to base 13. Part 13*a* is a hollow tube glued or otherwise secured into the depicted position. Said part 13*a* is a sleeve that receives vertical column 11. The offset mounting of sleeve 13*a* with respect to base 13 is not critical to the invention. Many other mechanically robust bases could be used to support the operative elements of the invention. All alternative bases are within the scope of this invention.

Novel system 10 can be mounted on the ground, a floor, a table, or other support surface. It may also be suspended from an upstanding support. A handle, not depicted, could be provided to envelope a small gauge wire for hanging purposes. Novel system 10 may be used at indoor and outdoor shooting ranges or home venues.

Two or more of the novel systems in any configuration may be interconnected to one another by a vertical connector member. The vertical connector, not depicted, would include a plurality of perforated and pre-scored lines. The vertical connector could also be used to hang a bracket which would allow the system to be suspended as mentioned above.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A target practice apparatus adapted to receive at least one projectile fired at it by a remotely positioned shooter, comprising:

a motor having an output shaft;

a housing for said motor;

a motor housing post secured to said motor and said motor housing;

a mounting member having a first side located opposite a second side, said first side of said mounting member is connected to a portion of said output shaft;

a target disc is releasably secured to said second side of said mounting member with at least one fastener for conjoint rotation therewith, whereby, said target disc is configured to have at least one projectile pass through said target disc;

a vertical support column having a first end located opposite a second end, said motor housing post is removably connected to at least one portion of said vertical support column, whereby, said target disc is capable of being configured in a first orientation; and, an elbow member is removably connected to said at least one portion of said vertical support column, said motor housing post is removably connected to a portion of said elbow member, whereby, said target disc is capable of being configured in a second orientation.

2. The target practice apparatus of claim 1, further comprising:

said target disc having at least one hingedly foldable target tab connected to a portion of an outer perimeter of said target disc, said at least one hingedly foldable target tab having a first fold line located on a portion of said outer perimeter of said target disc, said at least one hingedly foldable target tab having a second fold line located perpendicular to said first fold line, said at least one hingedly foldable target tab having a tab, said tab protruding from a perimeter of said at least one hingedly foldable target tab, said tab is configured to be separated from said target disc by a user when said at least one hingedly foldable target tab is folded at said second fold line.

3. The target practice apparatus of claim 2, further comprising:

said at least one hingedly foldable target tab has at least one decal connected to a surface of said at least one hingedly foldable target tab.

4. The target practice apparatus of claim 2, further comprising:

said target disc having at least one opening great enough in size to retain said tab of said at least one hingedly foldable target tab.

5. The target practice apparatus of claim 1, further comprising:

said target disc having at least one decal connected to a surface of said target disc.

6. The target practice apparatus of claim 1, further comprising:

said mounting member having at least one opening configured to receive said output shaft of said motor.

7. The target practice apparatus of claim 1, further comprising:

said target disc having at least one opening configured to receive said output shaft of said motor.

8. The target practice apparatus of claim 1, further comprising:

said second end of said vertical support column being connected to a base.

9. The target practice apparatus of claim 1, further comprising:

said vertical support column being extendable.

10. The apparatus of claim 1, further comprising:

a platform having an opening, whereby, said opening receives said vertical support column, said platform is configured to slidably traverse said vertical support column, a blocker arm having a first end located opposite a second end, said first end of said blocker arm is connected to a portion of said platform, whereby, said blocker arm is oriented in a configuration to form a barrier between said at least one projectile and said motor, said second end of said blocker arm is connected to a surface of a removable blocker disc, said removable blocker disc is oriented in closely spaced parallel relation to said removable target disc, whereby, said removable blocker disc covers at least a portion of said removable target disc.

11. The apparatus of claim 10, further comprising:

said removable blocker disc having at least one opening, whereby, said at least one opening has a size great enough for a portion of a decal connected to said target disc to be visible through said at least one opening.

12. The apparatus of claim 10, further comprising:

said vertical support column having a rubber-type grommet connected thereto.

13. A target practice apparatus, comprising:

a motor having an output shaft;

a housing for said motor;

a motor housing post secured to said motor and said motor housing;

a mounting member having a first side located opposite a second side, said first side of said mounting member is connected to a portion of said output shaft;

a target disc is releasably secured to said second side of said mounting member with at least one fastener for conjoint rotation therewith, whereby, said target disc is configured to have at least one projectile pass through said target disc;

a vertical support column having a first end located opposite a second end, said motor housing post is removably connected to at least one portion of said vertical support column, whereby, said target disc is capable of being configured in a first orientation;

an elbow member is removably connected to said at least one portion of said vertical support column, said motor housing post is removably connected to a portion of said elbow member, whereby, said target disc is configured in a second orientation;

a platform having an opening, whereby, said opening receives said vertical support column, said platform is configured to slidably traverse said vertical support column;

a blocker arm having a first end located opposite a second end, said first end of said blocker arm is connected to said platform, whereby, said blocker arm is oriented in a configuration to form a barrier between said at least one projectile and said motor; and, said second end of said blocker arm is connected to a removable blocker disc, said removable blocker disc is oriented in closely spaced parallel relation to said removable target disc, whereby, said removable blocker disc covers at least a portion of said removable target disc.

14. The apparatus of claim 13, further comprising:

said removable blocker disc having at least one opening, whereby, said at least one opening has a size great enough for a portion of a decal connected to said target disc to be visible through said at least one opening.

15. The apparatus of claim 13, further comprising:

said vertical support column having a rubber-type grommet connected thereto.

16. The target practice apparatus of claim 13, further comprising:

said target disc having at least one hingedly foldable target tab connected to a portion of an outer perimeter of said target disc, said at least one hingedly foldable target tab having a first fold line located on a portion of said outer perimeter of said target disc, said at least one hingedly foldable target tab having a second fold line located perpendicular to said first fold line, said at least one hingedly foldable target tab having a tab, said tab protruding from a perimeter of said at least one hingedly foldable target tab, said tab is configured to be separated from said target disc by a user when said at least one hingedly foldable target tab is folded at said second fold line.

17. A target practice apparatus, comprising:

a motor having an output shaft;

a housing for said motor;

a motor housing post secured to said motor and said motor housing;

a mounting member having a first side located opposite a second side, said first side of said mounting member is connected to a portion of said output shaft;

a target disc is releasably secured to said second side of said mounting member with at least one fastener for conjoint rotation therewith, whereby, said target disc is configured to have at least one projectile pass through said target disc;

said target disc having at least one hingedly foldable target tab connected to a portion of an outer perimeter of said target disc, said at least one hingedly foldable target tab having a first fold line located on a portion of said outer perimeter of said target disc, said at least one hingedly foldable target tab having a second fold line located perpendicular to said first fold line, said at least one hingedly foldable target tab having a tab, said tab protruding from a perimeter of said at least one hingedly foldable target tab, said tab is configured to be separated from said target disc by a user when said at least one hingedly foldable target tab is folded at said second fold line;

said target disc having at least one opening great enough in size to retain said tab of said at least one hingedly foldable target tab;

a vertical support column having a first end located opposite a second end, said motor housing post is removably connected to at least one portion of said vertical support column, whereby, said target disc is capable of being configured in a first orientation; and, an elbow member is removably connected to said at least one portion of said vertical support column, said motor housing post is removably connected to a portion of said elbow member, whereby, said target disc is configured in a second orientation.

* * * * *